US007253810B2

(12) United States Patent
Ito et al.

(10) Patent No.: US 7,253,810 B2
(45) Date of Patent: Aug. 7, 2007

(54) LIQUID CRYSTAL DISPLAY HAVING DATA DRIVER AND GATE DRIVER

(75) Inventors: Takae Ito, Kawasaki (JP); Kazuhiro Nukiyama, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 141 days.

(21) Appl. No.: 10/356,461

(22) Filed: Jan. 31, 2003

(65) Prior Publication Data

US 2003/0151585 A1 Aug. 14, 2003

(30) Foreign Application Priority Data

Feb. 1, 2002 (JP) ..... 2002-025446

(51) Int. Cl.
*G09G 5/00* (2006.01)
*G09G 3/36* (2006.01)

(52) U.S. Cl. ..... 345/204; 345/87; 345/98; 345/99; 345/103

(58) Field of Classification Search ..... 345/99, 345/87, 100, 103, 204, 58, 1.1, 30, 38, 48, 345/51, 55, 98
See application file for complete search history.

(56) References Cited

U.S. PATENT DOCUMENTS 5,657,041 A * 8/1997 Choi ..... 345/99
6,040,814 A * 3/2000 Murakami et al. ..... 345/94
6,329,975 B1 * 12/2001 Yamaguchi ..... 345/99
6,525,710 B1 * 2/2003 Kwon ..... 345/100
2002/0089485 A1 * 7/2002 Youn ..... 345/99
2005/0024312 A1 * 2/2005 Isami et al. ..... 345/89

FOREIGN PATENT DOCUMENTS

| | | |
|---|---|---|
| JP | 9-269753 | 10/1997 |
| JP | 10-268825 | 10/1998 |
| JP | 10-282936 | 10/1998 |
| JP | 11-259036 | 9/1999 |
| JP | 2000-206943 | 7/2000 |

* cited by examiner

*Primary Examiner*—Kee M. Tung
*Assistant Examiner*—Chante Harrison
(74) *Attorney, Agent, or Firm*—Greer, Burns & Crain, Ltd.

(57) ABSTRACT

A liquid crystal display can operate with as small a number of control signals supplied to individual drivers as possible while current control functions are maintained. The liquid crystal display comprises a liquid crystal panel containing a data line, a data driver driving a data line, and a controller outputting N control functions controlling a driving operation the data driver driving the data line through less than or equal to (N−1) control signal lines connected to the data driver.

8 Claims, 25 Drawing Sheets

LIQUID CRYSTAL DISPLAY HAVING DATA DRIVER AND GATE DRIVER

CROSS-REFERENCE TO RELATED APPLICATIONS

The present application is based on Japanese priority application No. 2002-025446 filed Feb. 1, 2002, the entire contents of which are hereby incorporated by reference.

BACKGROUND OF THE INVENTION

1. Field of the Invention

The present invention generally relates to drivers for driving a liquid crystal display, and more particularly to a gate driver for scanning a gate line of a liquid crystal display and a data driver for driving a data line of the liquid crystal display based on display data.

2. Description of the Related Art

In a liquid crystal display (LCD), dots including transistors are provided in the horizontal and vertical directions thereof. Gate lines extending in the horizontal direction are connected to gates of the transistors of the individual dots, and data lines extending in the vertical direction are connected to capacitors of the individual dots via the transistors. When data are displayed on the liquid crystal display, a gate driver sequentially drives an individual gate line so that transistors in the gate line can be charged with electricity. Data from a data driver whose amount corresponds to one horizontal line of the liquid crystal display are simultaneously written in individual dots in the gate line via the transistors charged with electricity.

FIG. 1 shows a structure of a conventional liquid crystal display.

The liquid crystal display in FIG. 1 comprises an LCD panel 10, a timing controller 11, a plurality of gate drivers 12, and a plurality of data drivers 13. Dots including transistors, which are not illustrated in FIG. 1, are provided in the horizontal and vertical directions of the LCD panel 10. Gate lines extending in the horizontal direction from the gate driver 12 are connected to gates of transistors of individual dots, and data lines extending in the vertical direction from the data driver 13 are connected to capacitors of the individual dots via the transistors.

The timing controller 11 receives a clock signal CK, display data IXX, and a display enable signal ENAB for indicating timing with respect to a display position via an interface I/F. The timing controller 11 counts clock pulses of the clock signal CK since the display enable signal ENAB becomes ON in order to determine timing with respect to a horizontal position and generate various control signals. Furthermore, the timing controller 11 examines the number of the display enable signals ENAB to determine timing with respect to a vertical position and generate various control signals. Additionally, the timing controller 11 can detect a position of the head of each frame by finding a position where the display enable signal ENAB remains LOW during more than a predetermined number of clock pulses.

The control signal supplied to the gate driver 12 by the timing controller 11 contains a gate clock signal GCLK, a gate start signal GST, and a gate output enable signal GOE. The gate clock signal GCLK is a synchronizing signal for sequentially shifting individual gate lines driven synchronously with the rising edge of the gate clock signal GCLK. Additionally, the gate clock signal GCLK also serves as a synchronizing signal for sequentially shifting individual transistors included in a gate line being ON gates in the vertical direction synchronously with the rising edge of the gate clock signal GCLK. The gate start signal GST is a synchronizing signal for designating timing when the head of gate lines is switched ON, that is, the timing corresponding to the start timing of a frame. The gate output enable signal GOE is a signal for designating to make all gate lines non-driven by switching the above-mentioned operation.

A control signal supplied to the data driver 13 by the timing controller 11 contains a dot clock signal DCK, a data start signal DST, a latch pulse LP, and a polarity signal POL. The dot clock signal DCK is a clock pulse for fetching display data DXX in a register synchronously with the rising edge of the dot clock signal DCK. The data start signal DST is a signal for designating a start position of the display data DXX that the data driver 13 is responsible to display. Timing of the data start signal DST is set as the start point, and the display data DXX corresponding to an individual dot is sequentially fetched in the register in accordance with the dot clock signal DCK. The latch pulse LP is a signal for latching the display data DXX sequentially fetched in the register to an internal latch. The latched display data signal is transmitted to a DA converter. Then, the DA converter converts the transmitted display data signal into an analog gradation signal, and the converted analog gradation signal is supplied to the LCD panel 10 as a data line driving signal. The polarity signal POL is a signal supplied to the DA converter and designates an output polarity of each data line. In order to prevent characteristic deterioration of the liquid crystal of the liquid crystal display, it is necessary to periodically inverse the output polarity of the individual data line. Accordingly, the polarity signal POL is used to determine the output polarity of the data line for a common voltage.

When these control signals are deteriorated under the influence of noise, there is a probability that the deterioration causes a crucial improper operation of the liquid crystal display. Thus, with respect to wirings for the control signals, it is necessary to care for crosstalk between the wirings and mount the wirings for the control signals without congestion. However, the comparatively large number of the control signal cables compels the wiring board thereof to have a large area and consequently adversely affects the cost reduction. Thus, it is desired to minimize the number of control signals supplied to the individual drivers insofar as the current control functions are maintained.

Besides the above-mentioned problem on the control signals, there is a similar problem on the display data. A recent liquid crystal display is designed to increase the number of data lines driven by data drivers thereof. Namely, the recent liquid crystal display is formed so as to receive two types of display data with respect to an even dot and an odd dot in order to achieve the high fineness and the high quality display. In this structure, it is possible to finely display the display data, and at the same time to set the transmission speed of the display data at the speed to which devices therein can normally react. For instance, when the transmission path is divided into the two types, it is possible to reduce the transmission frequency to ½.

The display data are required to have the number of signals corresponding to bits for the number of the display gradation because the display data have the separate number of signals for individual RGB components. For instance, when 8 bits (256 gradations) are prepared to display a color image, it is necessary to prepare 8 (bits)×3 (3 colors for the RGB)×2 (even and odd dots)=48 signal lines. When the large number of signal lines is mounted, the liquid crystal display is forced to have a large wiring substrate. Then arises the problem of the increasing cost for parts used in the liquid crystal display.

SUMMARY OF THE INVENTION

It is a general object of the present invention to provide a liquid crystal display in which the above-mentioned problems are eliminated.

A more specific object of the present invention is to provide a liquid crystal display wherein the number of control signals supplied to each driver can be reduced as much as possible insofar as current control functions are maintained.

Additionally, another more specific object of the present invention is to provide a liquid crystal display wherein the number of data signals supplied to data drivers of the liquid crystal display can be reduced insofar as compatibility of an interface with a current apparatus.

In order to achieve the above-mentioned objects, there is provided according to one aspect of the present invention a liquid crystal display, comprising: a liquid crystal panel containing a data line; a data driver driving the data line; and a controller outputting N control functions of controlling a driving operation of the data driver driving the data line to less than or equal to (N−1) control signal lines connected to the data driver.

According to the above-mentioned invention, since the N control functions of controlling the driving operation of the data driver can be aggregated as a signal on less than or equal to (N−1) control signal lines driving the data line, it is possible to reduce the number of control signal lines.

Additionally, there is provided according to another aspect of the present invention a liquid crystal display, comprising: a liquid crystal panel containing a gate line; a gate driver driving the gate line; and a controller outputting N control functions of controlling a driving operation of the gate driver driving the gate driver to less than or equal to (N−1) control signal lines connected to the gate driver.

According to the above-mentioned invention, since the N control functions of controlling the driving operation of the gate driver can be aggregated as a signal on less than or equal to (N−1) control signal lines driving the data line, it is possible to reduce the number of control signal lines.

Further, there is provided according to another aspect of the present invention a liquid crystal display, comprising: a liquid crystal panel containing a data line; a data driver driving the data line based on display data; and a controller receiving two types of display data, even display data and odd display data, from an exterior and supplying single display data formed by integrating the even display data and the odd display data to the data driver.

According to the above-mentioned invention, when the two types of display data, the even display data and the odd display data, are received from an exterior of the liquid crystal display, the two types of display data are integrated into the single display data and then the integrated display data are transmitted to the data driver. As a result, it is possible to reduce the number of data signal lines supplied to the data driver while the compatibility of an interface with a conventional liquid crystal display can be maintained.

Other objects, features and advantages of the present invention will become more apparent from the following detailed description when read in conjunction with the accompanying drawings.

DETAILED DESCRIPTION OF THE PREFERRED EMBODIMENTS

In the following, embodiments of the present invention will be described with reference to the accompanying drawings.

Figure 2:
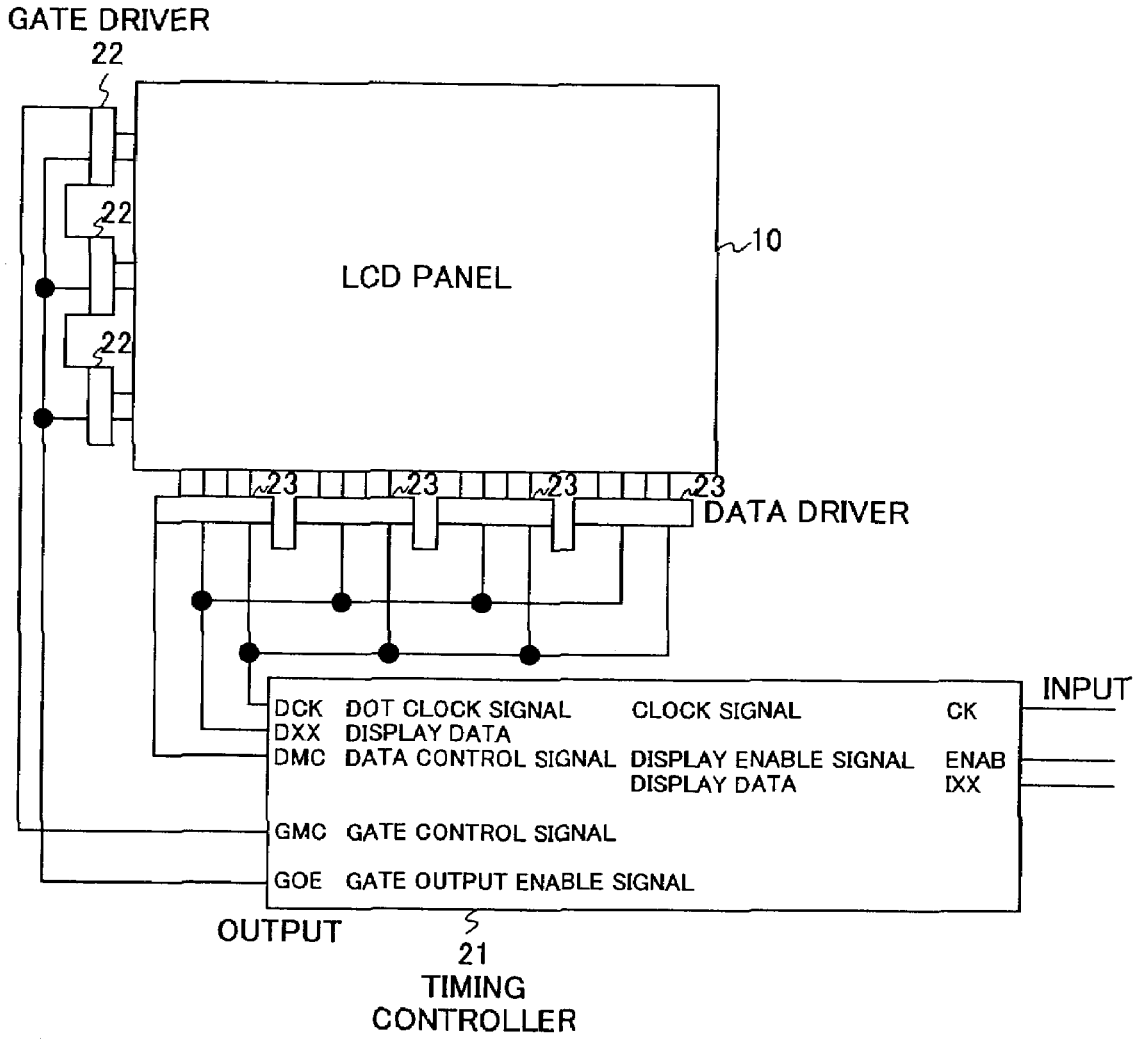
FIG. 2 is a diagram illustrating a structure of a liquid crystal display according to a first embodiment of the present invention.

FIG. 2 shows a structure of a liquid crystal display according to the first embodiment of the present invention.

The liquid crystal display shown in FIG. 2 comprises an LCD panel 10, a timing controller 21, a plurality of gate drivers 22, and a plurality of data drivers 23. Dots including transistors, which are not illustrated in FIG. 2, are provided in the horizontal and vertical directions of the liquid crystal display. Gate lines extending in the horizontal direction from the gate drivers 22 are connected to gates of transistors included in the individual dots, and data lines extending in the vertical direction from the data drivers 23 are connected to capacitors of the individual dots via the transistors.

The timing controller 21 receives a clock signal CK, display data IXX, and a display enable signal ENAB for indicating timing with respect to a display position via an interface I/F. The timing controller 21 counts a clock pulse of the clock signal CX since the display enable signal ENAB becomes ON in order to determine timing with respect to a horizontal position and generate various control signals. Also, the timing controller 21 examines the number of the display enable signals ENAB to determine timing with respect to a vertical position and generate various control signals. Furthermore, it is possible to detect the head position of each frame by finding a position where the display enable signal ENAB remains LOW during more than a predetermined number of the clock pulses thereof.

The timing controller 21 supplies a gate control signal GMC to the gate drivers 22. The gate control signal GMC integrally contains a gate clock signal GCLK and a gate start signal GST mentioned in FIG. 1. The gate driver 22 extracts logic levels of the gate clock signal GCLK and the gate start signal GST from the received gate control signal GMC, and at the same time uses a gate output enable signal GOE received from the timing controller 21 to perform a predetermined operation like the gate driver described with respect to FIG. 1.

A control signal supplied to the data driver 23 by the timing controller 21 contains a dot clock signal DCK and a data control signal DMC. The data control signal DMC integrally contains a data start signal DST, a latch pulse LP, and a polarity signal POL described with respect to FIG. 1. The data driver 23 extracts logic levels of the data start signal DST, the latch pulse LP and the polarity signal POL from the received data control signal DMC, and at the same time uses a dot clock signal DCK and display data DXX received from the timing controller 21 to perform a predetermined operation like the data driver described with respect to FIG. 1.

Figure 3:
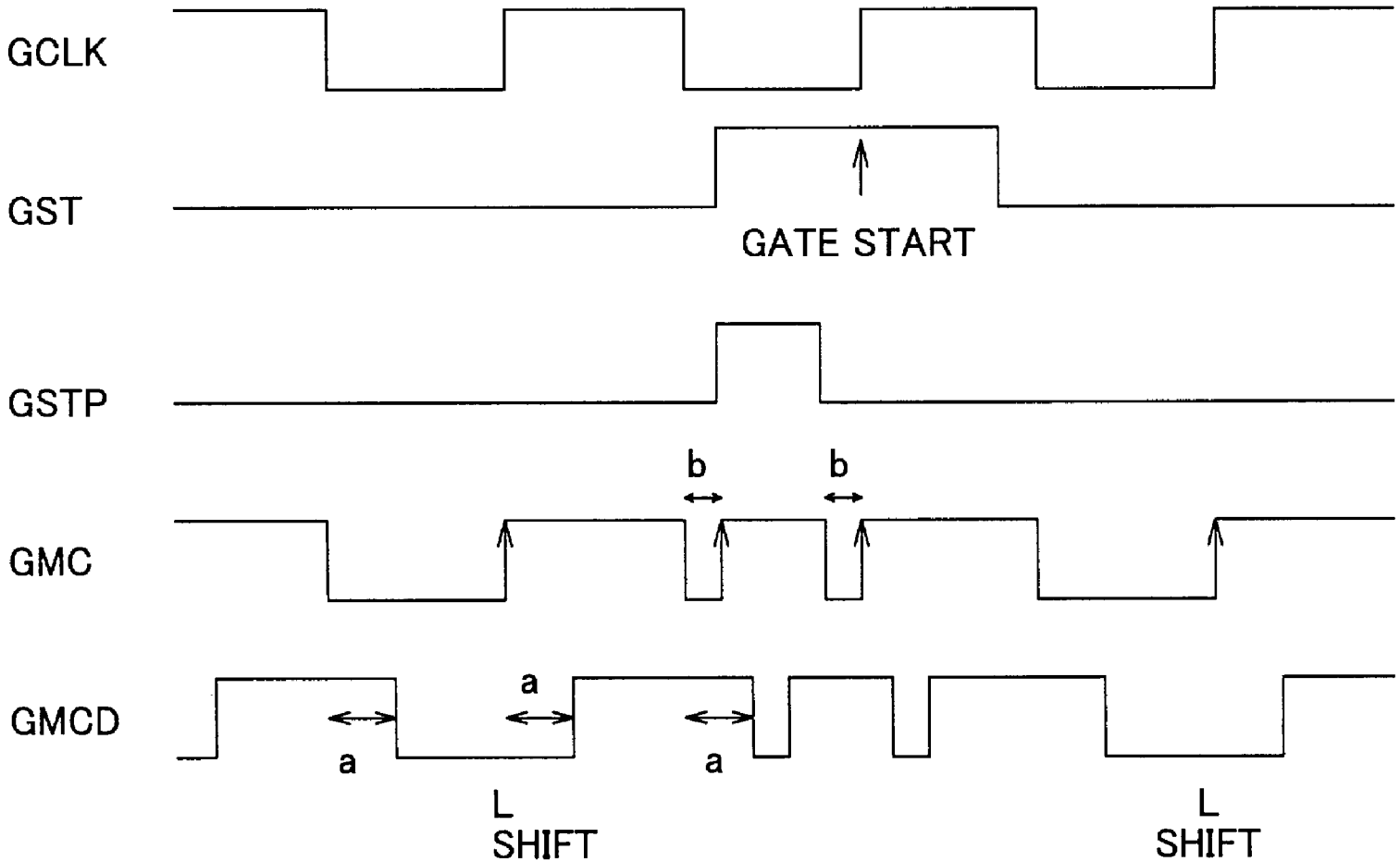
FIG. 3 is a signal waveform diagram for explaining generation and detection of a gate control signal GMC.

FIG. 3 is a signal waveform diagram for explaining generation and detection of the gate control signal GMC.

Figure 1:
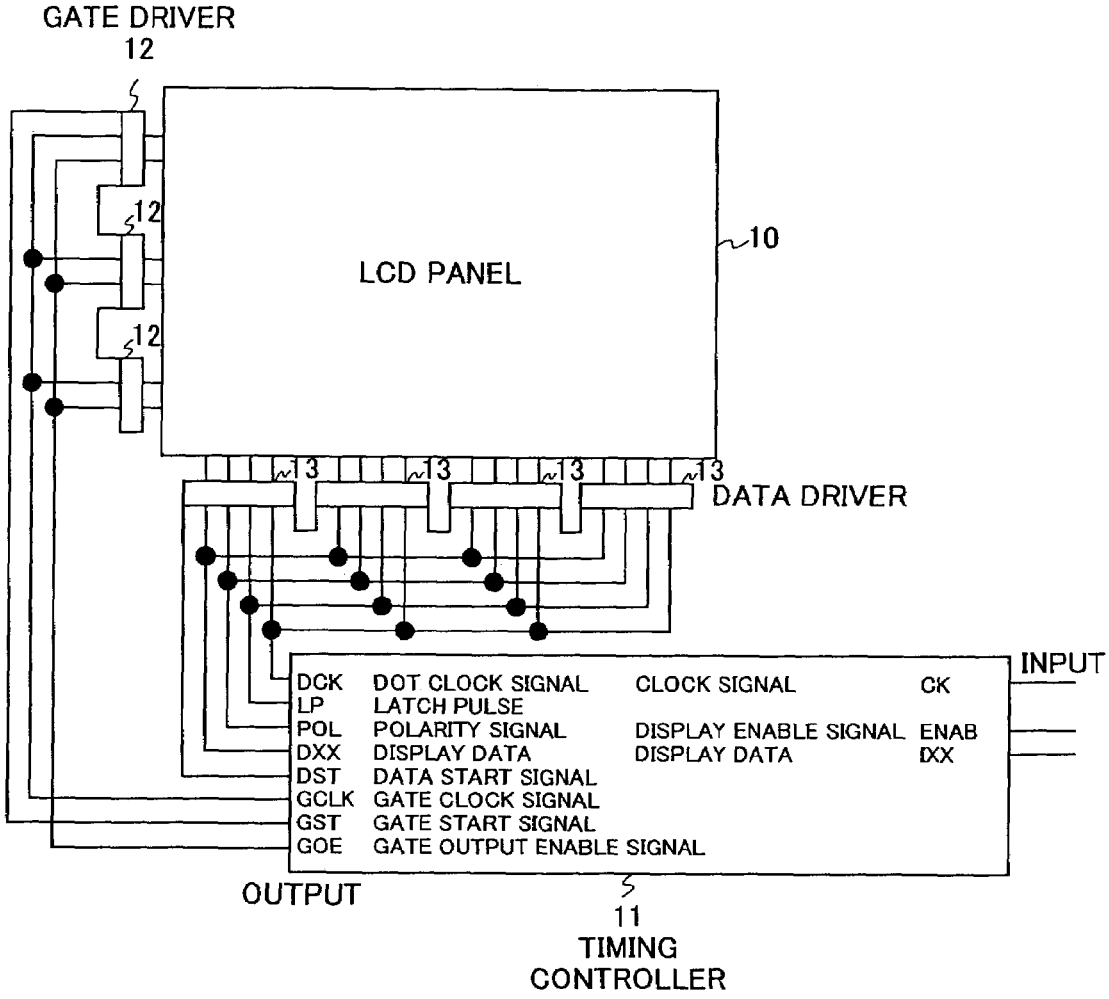
FIG.1 PRIOR ART
FIG. 1 is a diagram illustrating a structure of a conventional liquid crystal display.

In FIG. 3, the gate clock signal GCLK and the gate start signal GST are sorts of control signal based on the conventional liquid crystal display shown in FIG. 1. As is shown in FIG. 3, a pulse signal GSTP, which is initially at the same logic level as the gate start signal GST, becomes HIGH at one clock of the clock signal CK after the gate clock signal GCLK becomes LOW and LOW at one clock of the clock signal CK before the gate clock signal GCLK becomes HIGH. The gate control signal GMC is generated by taking OR of the gate clock signal GCLK and the pulse signal GSTP. As the liquid crystal display shown in FIG. 2, when a liquid crystal display uses a plurality of the gate drivers 22, the gate drivers 22 are connected in a cascade fashion to supply the gate control signal GMC thereto.

When the input gate control signal GMC is stayed in a predetermined time interval "a" within the gate driver 22 and then released, a delayed gate control signal GMCD is produced. The predetermined time interval "a" may be an arbitrary length as long as "a" is longer than the time interval ("b" in FIG. 3) in which the gate control signal GMC is LOW within the HIGH interval of the gate start signal GST. It is noted that the time interval "b" has to be shorter than a half of the frequency of the gate clock signal GCLK.

Next, the delayed gate control signal GMCD is read at a rising edge of the gate control signal GMC. That corresponds to reading the signal level of the gate control signal GMC being at a predetermined number of clocks before the gate control signal GMC becomes HIGH. In a portion of the gate clock signal GCLK where the gate start signal GST is LOW, the delayed gate control signal GMCD being LOW is read at a rising edge of the gate control signal GMC. In contrast, in a portion of the gate clock signal GCLK where the gate start signal GST is HIGH, the delayed gate control signal GMCD being HIGH is read two times in a row at the rising edge of the gate control signal GMC. The second HIGH signal timing of these HIGH signal timings is set as timing when the gate driver 22 of interest drives the head of gate lines. Hereinafter, the remaining gate lines are sequentially driven at the rising edge of the gate clock signal GCLK included in the gate control signal GMC.

Figure 4:
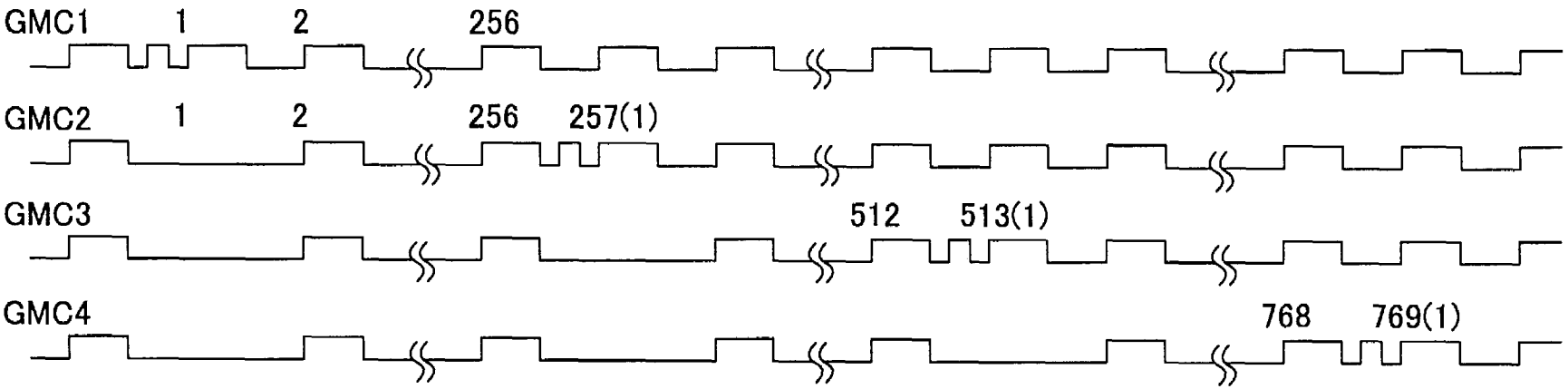
FIG. 4 is diagram illustrating gate control signals GMC supplied to each of a plurality of gate drivers connected in a cascade fashion.

FIG. 4 shows gate control signals GMC supplied to the individual gate drivers 22 connected in the cascade fashion. In FIG. 4, the notation GMCn represents a gate control signal supplied to the n-th gate driver 22.

As is shown in FIG. 2, the gate control signals GMC are propagated to the gate drivers in the cascade fashion. When each of the gate drivers 22 transmits a gate control signal GMC to a gate driver 22 being at the next stage, the gate driver 22 directly transmits the gate control signal GMC to the gate driver being at the next stage in the portion of the gate clock signal GCLK where the gate start signal GST becomes LOW. As a result, the gate control signal GMC is almost simultaneously transmitted to all of the gate drivers 22 in the above-mentioned portion of the gate clock signal GCLK.

Regarding the signal waveform for indicating a position of the gate start signal GST, the gate start signal GST has to be provided for each of the gate drivers 22 at a position corresponding to timing when a gate line starts to be driven. The head gate driver 22 is provided with the position of the start pulse signal GST by the timing controller 21. A subsequent gate driver 22 is provided with the position of the gate start signal GST by the gate driver 22 being at the previous stage and then transmits the gate control signal GMC received from the gate driver 22 being at the previous stage to the gate driver 22 being at the next stage.

FIG. 4 shows a case where four 256-output gate drivers 22 are connected in the cascade fashion. A portion corresponding to the gate start signal GST is supplied to the head gate driver 22 by the timing controller 21 at timing when display data start to be written to the head gate line. The head gate driver 22 transmits the portion corresponding to the gate start signal GST to the gate driver 22 being at the next stage at timing when the head gate driver 22 reads the 256th gate clock signal GCLK. Similarly, the portion corresponding to the gate start signal GST is supplied to the third gate driver 22 at the 512th clock timing and the fourth gate driver 22 at the 768th clock timing. In this fashion, an operation to drive a gate is performed for entire one frame.

Figure 5:
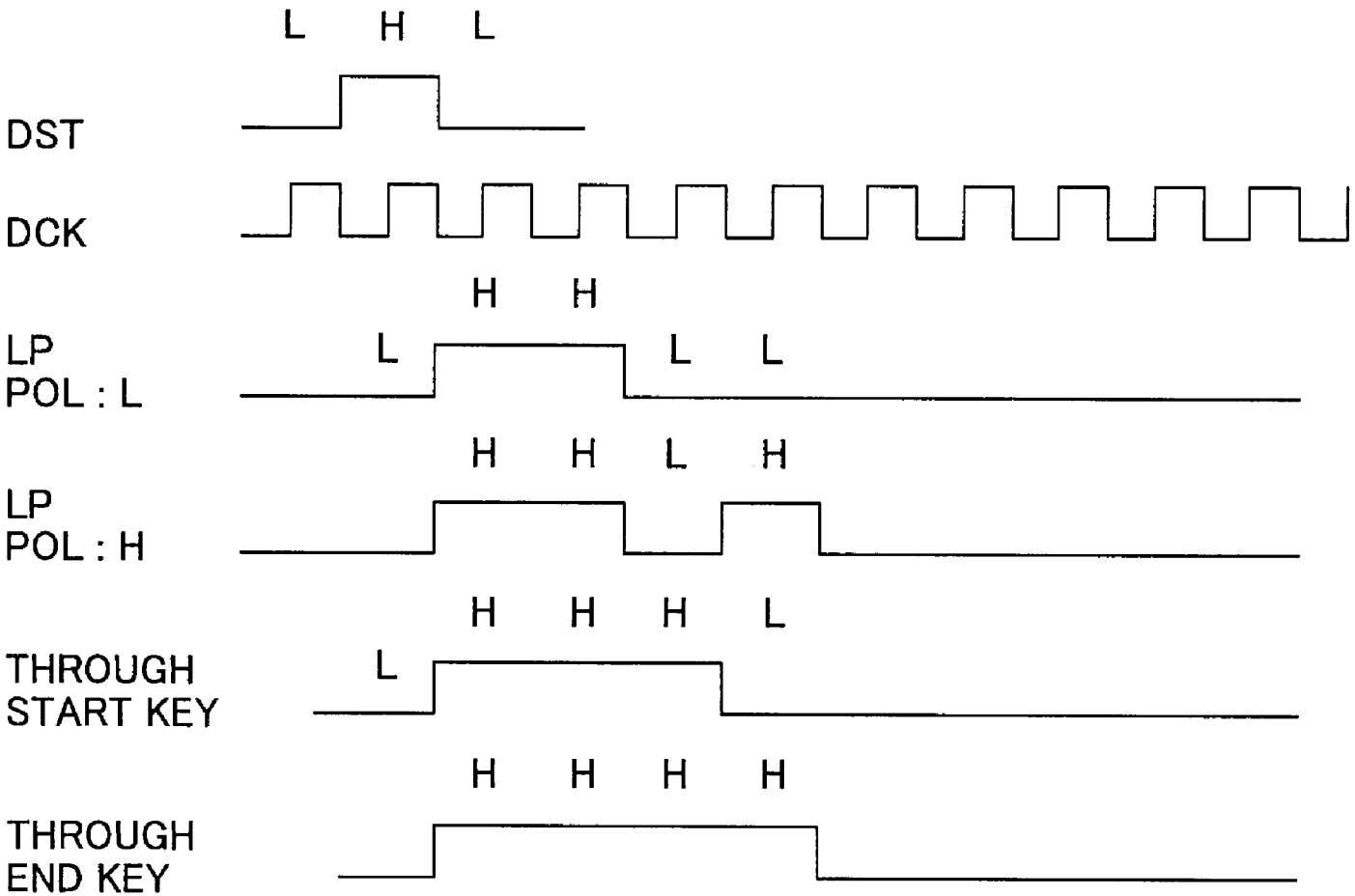
FIG. 5 is a diagram for explaining a data control signal DMC.

FIG. 5 is a diagram for explaining the data control signal DMC.

In the liquid crystal display according to the first embodiment of the present invention, the data control signal DMC represents the data start signal DST, the latch pulse LP, and the polarity signal POL as time series codes. A signal corresponding to the data start signal DST is generated similarly to the conventional data start signal DST and becomes HIGH only in one period of a dot clock DCK. As is shown in FIG. 5, the latch pulse LP and the polarity signal POL are represented as the time series codes "LHHLL" or "HHLH". In the case of "LHHLL", the codes "HH" indicate the latch timing. Thus, the code "L" at the timing skipped in one clock from the codes "HH" indicates that the polarity signal POL is LOW. In the case of "HHLH", the codes "HH" indicate the latch timing. Thus, the code "H" at the timing skipped in one clock from the codes "HH" indicates that the polarity signal POL is HIGH.

The data control signal DMC is sequentially propagated to the data drivers 23 connected in the cascade fashion. When the individual data drivers 23 receive the data control signal DMC, the individual data drivers 23 have to transmit the signal corresponding to the latch pulse LP and the polarity signal POL in the data control signal DMC without any timing modification to the next data driver 23. Consequently, a signal for defining the time interval in which the data driver 23 directly passes the received signal to the next data driver 23 is provided in advance to the liquid crystal display according to the first embodiment of the present invention. Namely, the gate driver 22 directly supplies the received signal to the next data driver 22 in the time interval between a through start key "LHHHL" and a through end key "HHHH". As a result, it is possible to almost simultaneously supply the latch pulse LP and the polarity signal POL to all the data drivers 23.

Figure 6:
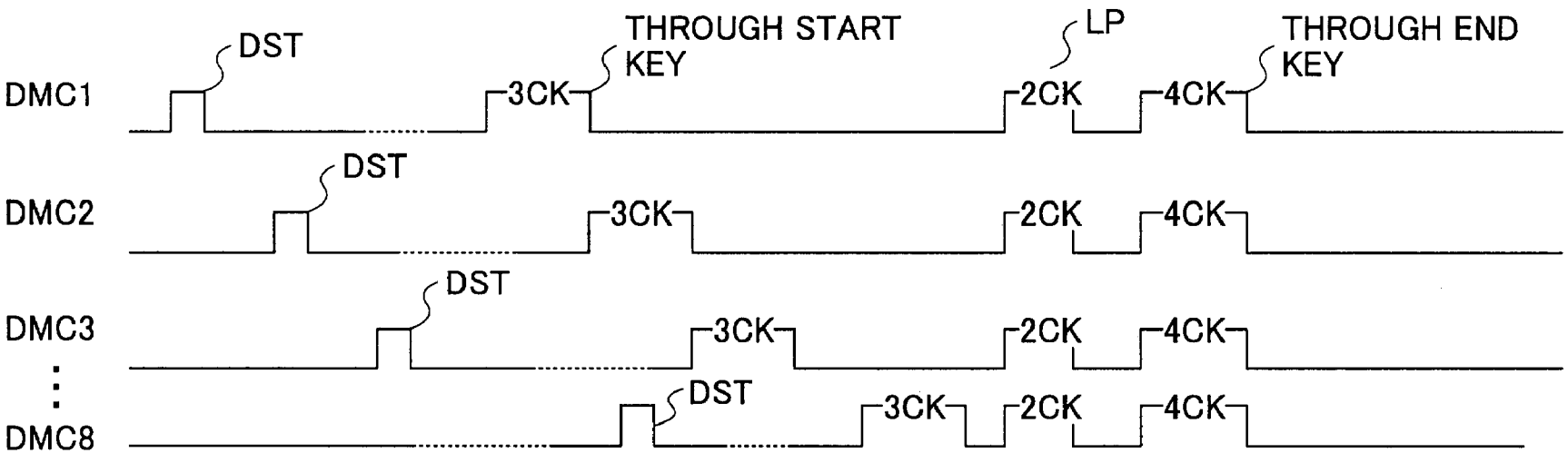
FIG. 6 is diagram illustrating data control signals DMC supplied to each of a plurality of gate drivers connected in a cascade fashion.

FIG. 6 shows data control signals DMC supplied to individual data drivers 23 connected in the cascade fashion. In FIG. 6, DMCn is a data control signal supplied to the n-th data driver 23. FIG. 6 shows a case where eight data drivers 23 are connected in the cascade fashion.

DMC 1 is supplied to the head data driver 23 by the timing controller 21 of the liquid crystal display. The head data driver 23 takes the DHC 1 synchronously with a clock. When the head data driver 23 finds that the DMC 1 becomes "LHL", the head data driver 23 starts to take the display data DXX with the next clock timing. For instance, when the 79th data are read, the head data driver 23 sets DMC 2 supplied to the next data driver 23 as "H" at the rising edge of the dot clock signal DCK. Then, when the 80th data are read, the head data driver 23 sets the DMC 2 supplied to the next data driver 23 as "L" at the rising edge of the dot clock signal DCK. The second data driver 23 starts to take the display data with the next timing when the DMC 2 becomes "LHL". In this fashion, it is possible to smoothly link and take the display data between the head data driver 23 and the second data driver 23. Hereinafter, the remaining data drivers 23 similarly fetch the display data.

Next, in order to prepare to transmit the latch pulse LP, the timing controller 21 transmits the through start key "LHHHL" to the head data driver 23. When a data driver 23 receives the through start key, the data driver 23 sequentially transmits the through start key to the next data driver 23. After the through start key is transmitted to the last data driver 23, the timing controller 21 transmits the signal for indicating the latch pulse LP to the head data driver 23. At this time, since all the data drivers 23 are in a through mode, the signal for indicating the latch pulse LP is immediately propagated to all the data drivers 23. After that, the timing controller 21 transmits the through end key "HHHH" and releases the through mode for all the data drivers 23.

A description will now be given of a circuit structure for implementing the first embodiment of the present invention.

Figure 7:
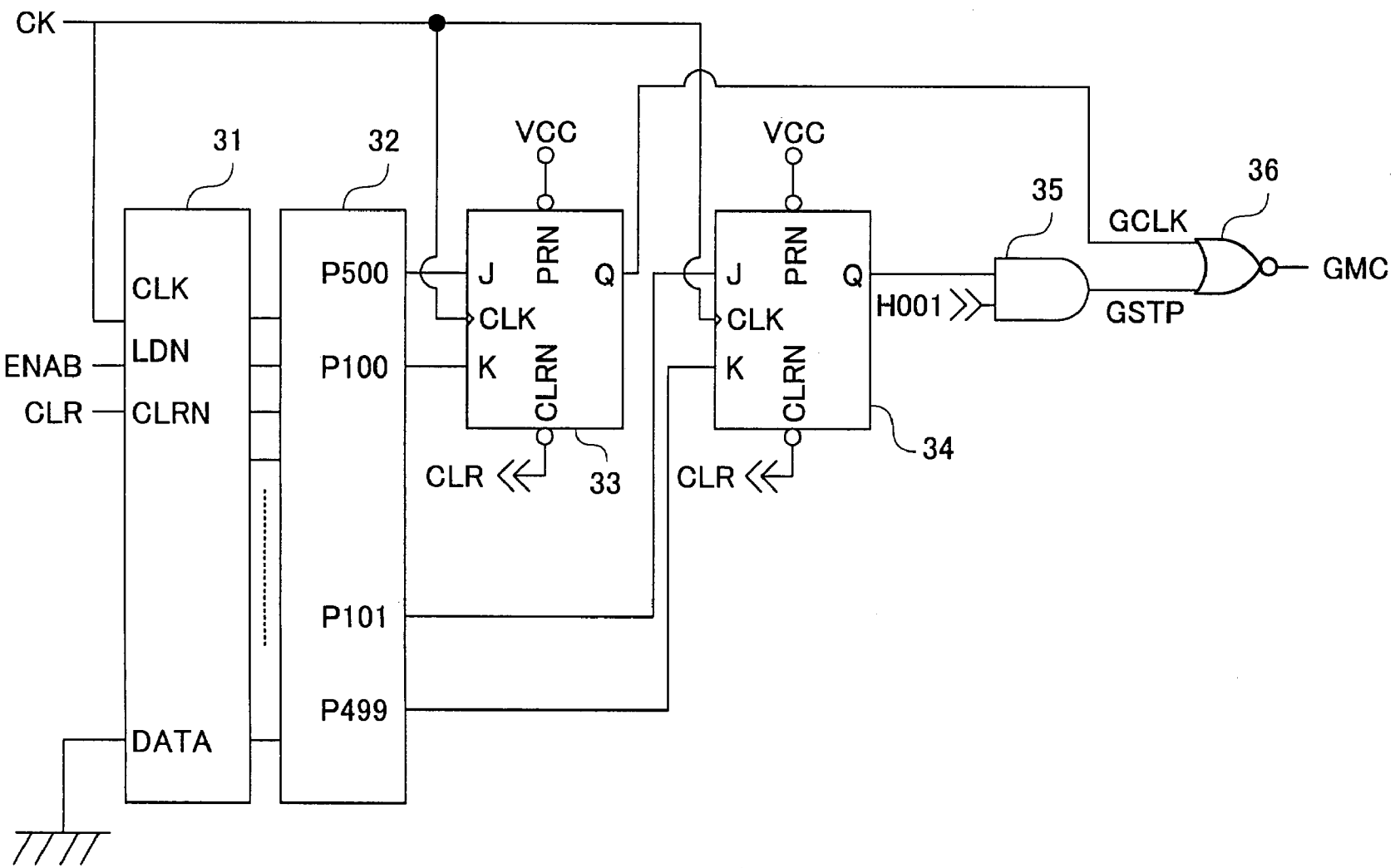
FIG. 7 is a diagram illustrating a circuit structure for generating a gate control signal GMC in a timing controller.

FIG. 7 shows a circuit structure for generating the gate control signal GMC in the timing controller 21.

The circuit in FIG. 7 contains a counter circuit 31, a decoder circuit 32, JK flip-flops 33 and 34, an AND circuit 35, and an OR circuit 36. The counter circuit 31 serves to count the clock signal CK for determining timing within one horizontal period with respect to a horizontal position. In response to the enable signal ENAB, the counter circuit 31 resets an internal count value by loading data DATA being zero. Then, the count value obtained through the counting of the clock signal CK is supplied to the decoder circuit 32. By decoding the count value of the counter circuit 31, the decoder circuit 32 generates a pulse signal P100 that becomes HIGH at the 100th clock pulse, a pulse signal P101 that becomes HIGH at the 101st clock pulse, a pulse signal P499 that becomes HIGH at the 499th clock pulse, and a pulse signal P500 that becomes HIGH at the 500th clock pulse.

The JK flip-flop 33 receives the pulse signal P500 as the J input and the pulse signal P100 as the K input and then outputs a gate clock signal GCLK being LOW between the clock timing 100 and the clock timing 500 and HIGH otherwise. On the other hand, the JK flip-flop 34 receives the pulse signal P101 as the J input and the pulse signal P499 as the K input and then outputs a signal being HIGH between the clock timing 101 and the clock timing 499 and LOW otherwise. The AND circuit 35 takes AND of the signal being HIGH between the clock timing 101 and the clock timing 499 and LOW other than the interval of the clock timing and a signal being HIGH only in the first one horizontal period to generate the pulse signal GSTP for indicating a gate start. The OR circuit 36 takes OR of the gate clock signal GCLK and the pulse signal GSTP to generate the gate control signal GMC. The gate clock signal GCLK, the pulse signal GSTP, and the gate control signal GMC have been described with respect to FIG. 3.

Figure 8:
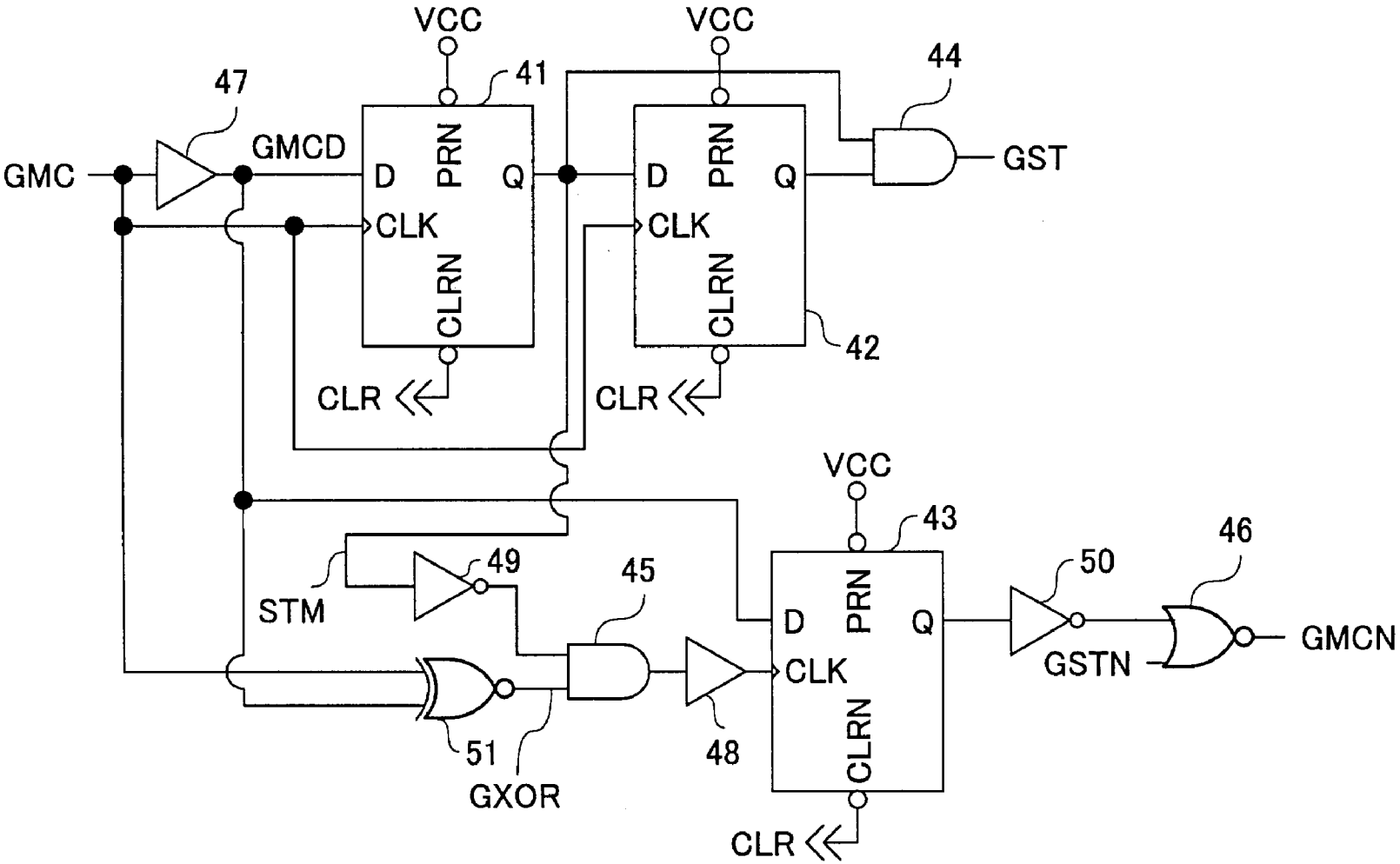
FIG. 8 is a diagram illustrating a circuit structure for extracting a gate start signal GST in an individual gate driver and generating a gate control signal for the next stage.

FIG. 8 shows a circuit structure for extracting the gate start signal GST in an individual gate driver 22 and generating a gate control signal to be supplied to the next gate driver 22.

The circuit in FIG. 8 contains D flip-flop 41 through 43, AND circuits 44 and 45, an OR circuit 46, a delay circuit 47, a buffer circuit 48, inverters 49 and 50, and an XOR circuit 51.

The delay circuit 47, which is formed of a delay element, generates the delayed gate control signal GMCD by delaying the gate control signal GMC. The delayed gate control signal GMCD has been shown in FIG. 3. The D flip-flop 41 receives the gate control signal GMC as the clock input CLK and latches the delayed gate control signal GMCD at a rising edge of the clock input CLK. An output signal of the D flip-flop 41 is LOW in the portion of the gate clock signal GCLK where the gate start signal GST is LOW. On the other hand, in the portion of the gate clock signal GCLK where the gate start signal GST is HIGH, the D flip-flop 41 reads the gate control signal being HIGH two times in a row at a rising edge of the gate control signal GMC. Furthermore, the D flip-flop 42 reads the output signal of the D flip-flop 41 at a rising edge of the gate control signal GMC. The AND circuit 44 takes AND of the outputs of the D flip-flops 41 and 42 and outputs the gate start signal GST only when the gate control signal GMCD being HIGH two times in a row is read.

Figure 9:
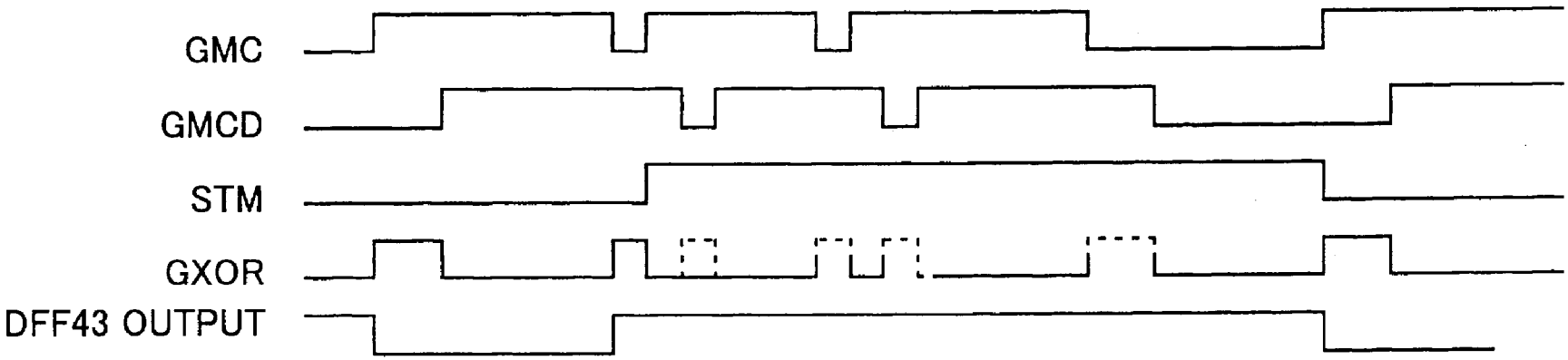
FIG. 9 is a waveform diagram for explaining an operation for generating a gate control signal GMCN.

FIG. 9 shows a waveform diagram for explaining an operation for generating a gate control signal GMCN supplied from a gate driver 22 to the next gate driver 22. The XOR circuit 51 in FIG. 8 takes exclusive OR of the gate control signal GMC and the delayed gate control signal GMCD to generate a signal GXOR shown in FIG. 9. Here, a signal STM shown in FIG. 9 is the output signal of the D flip-flop 41. As is shown in FIG. 8, the AND circuit 45 takes AND of the signal GXOR and the inverted signal of the signal STM to remove pulse portions shown by dot lines of the signal GXOR in FIG. 9. The D flip-flop 43 latches the delayed gate control signal GMCD at a rising edge of the resulting signal. As a result, an output signal of the D flip-flop 43 has a waveform as shown in the last signal DFF43 in FIG. 9. If a gate start signal GSTN, which serves to indicate the start timing of the next gate driver 22, is added to the output signal of the D flip-flop 43 to generate the gate control signal GMCN to be supplied to the next gate driver 22.

Figure 10:
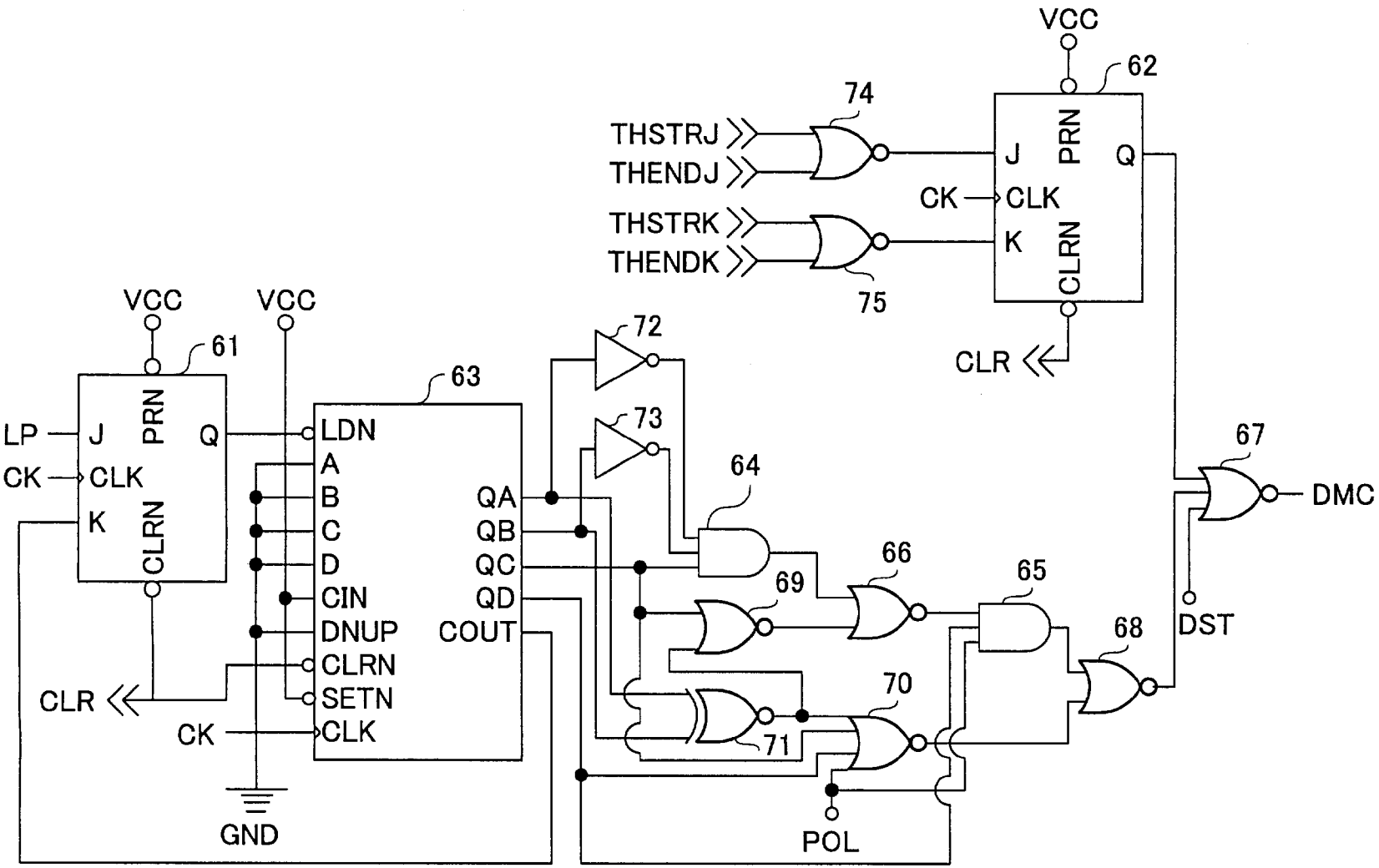
FIG. 10 is a diagram illustrating a circuit structure for generating a data control signal DMC in the timing controller.

FIG. 10 shows a circuit structure for generating the data control signal DMC in the timing controller 21.

The circuit in FIG. 10 contains JK flip-flops 61 and 62, a counter circuit 63, AND circuits 64 and 65, OR circuits 66 through 68, NOR circuits 69 and 70, an XNOR circuit 71, inverters 72 and 73, OR circuits 74 and 75.

The JK flip-flop 61 latches the latch pulse LP. At the same time, the latch operation resets the counter circuit 63 as zero. Then, the counter circuit 63 counts pulses of the clock signal CK. A logic circuit in FIG. 10 performs some logic operations for counter outputs QA through QD of the counter circuit 63, and finally the OR circuit 68 outputs the time series codes for indicating the latch pulse LP and the polarity POL. The JK flip-flop 62 receives signals THSTRJ and THSTRK for indicating timing of a through start key and outputs a through start key signal being HIGH at the timing of the signal THSTRJ and LOW at the timing of the signal THSTRK. Furthermore, the JK flip-flop 62 receives signals THENDJ and THENDK for indicating timing of a through end key and outputs a through end key signal. The OR circuit 67 takes OR of the signal for indicating the latch pulse LP and the polarity POL from the OR circuit 68, the through key from the JK flip-flop 62, and a data start signal DST to generate the data control signal DMC.

Figure 11:
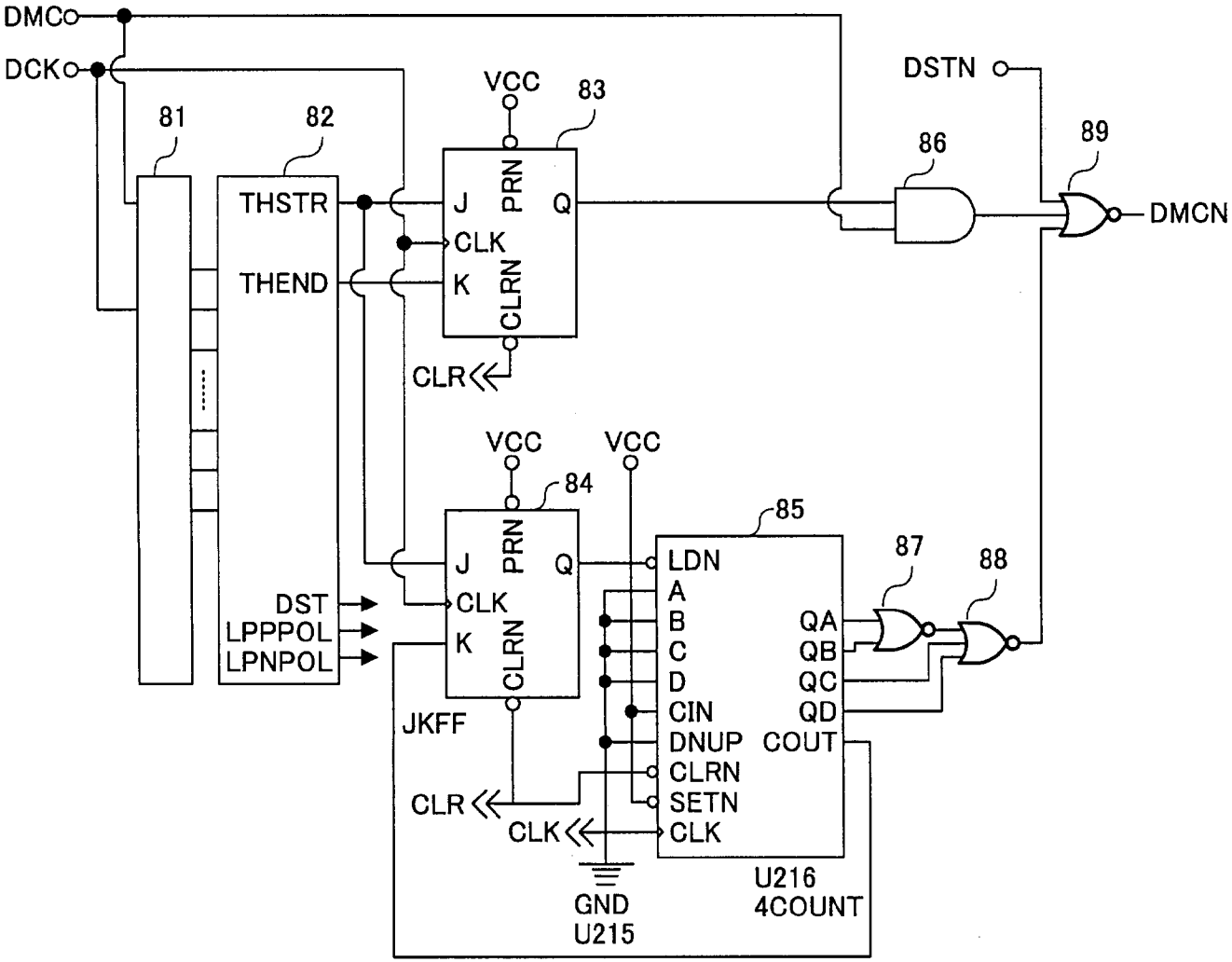
FIG. 11 is a diagram illustrating a circuit structure for extracting various control signals from the data control signal DMC in the individual data driver and generating a data control signal for the next stage.

FIG. 11 shows a circuit structure for extracting various signals from the data control signal DMC provided to an individual data driver 23 and generating a data control signal for the next data driver 23.

The circuit in FIG. 11 contains a shift register circuit 81, a decoder circuit 82, JK flip-flops 83 and 84, a counter circuit 85, an AND circuit 86, NOR circuits 87 and 88, and an OR circuit 89. The shift register circuit 81 sequentially stores the supplied data control signal DMC in an internal register circuit synchronously with a dot clock signal DCK. The decoder circuit 82 decodes data formed of a plurality of cycles of the data control signal DMC stored by the shift register circuit 81 and outputs detection signals THSTR, THEND, DST, LPPPOL, and LPNPOL. The detection signals THSTR, THEND, DST, LPPPOL, and LPNPOL represent through start key detection, through end key detection, data start signal detection, latch pulse and positive polarity detection, and latch pulse and negative polarity detection, respectively. For instance, the detection signal THSTR is implemented by a logic circuit that sets the detection signal THSTR as HIGH only if the DMC being at a current cycle is LOW, the DMC being at the first previous cycle is HIGH, the DMC being at the second previous cycle is HIGH, the DMC being at the third previous cycle is HIGH, and the DMC being at the fourth previous cycle is LOW.

By using the through start key detection as the start timing, the JK flip-flop 84, the counter circuit 85, the NOR circuits 87 and 88 generate a signal being HIGH in the interval of 3 clocks. This signal is supplied to the next data driver 23 as the through start key via the OR circuit 89. A data start signal DSTN for indicating the data start timing for the next data driver 23 is generated in the data driver 23 similarly to a conventional fashion. The data start signal DSTN is supplied as the data start signal to the next data driver 23 via the OR circuit 89.

The JK flip-flop 83 is outputting HIGH from timing when the through start key is detected to timing when the through end key is detected. Since the HIGH signal causes the AND circuit 86 to be in the through status, the data control signal DMC passes through the AND circuit 86. As a result, it is possible to supply the data control signal DMC from the data driver 23 being at the current stage to the data driver 23 being at the next stage in the simultaneous timing while the AND circuit 86 is in the through status.

Figure 12:
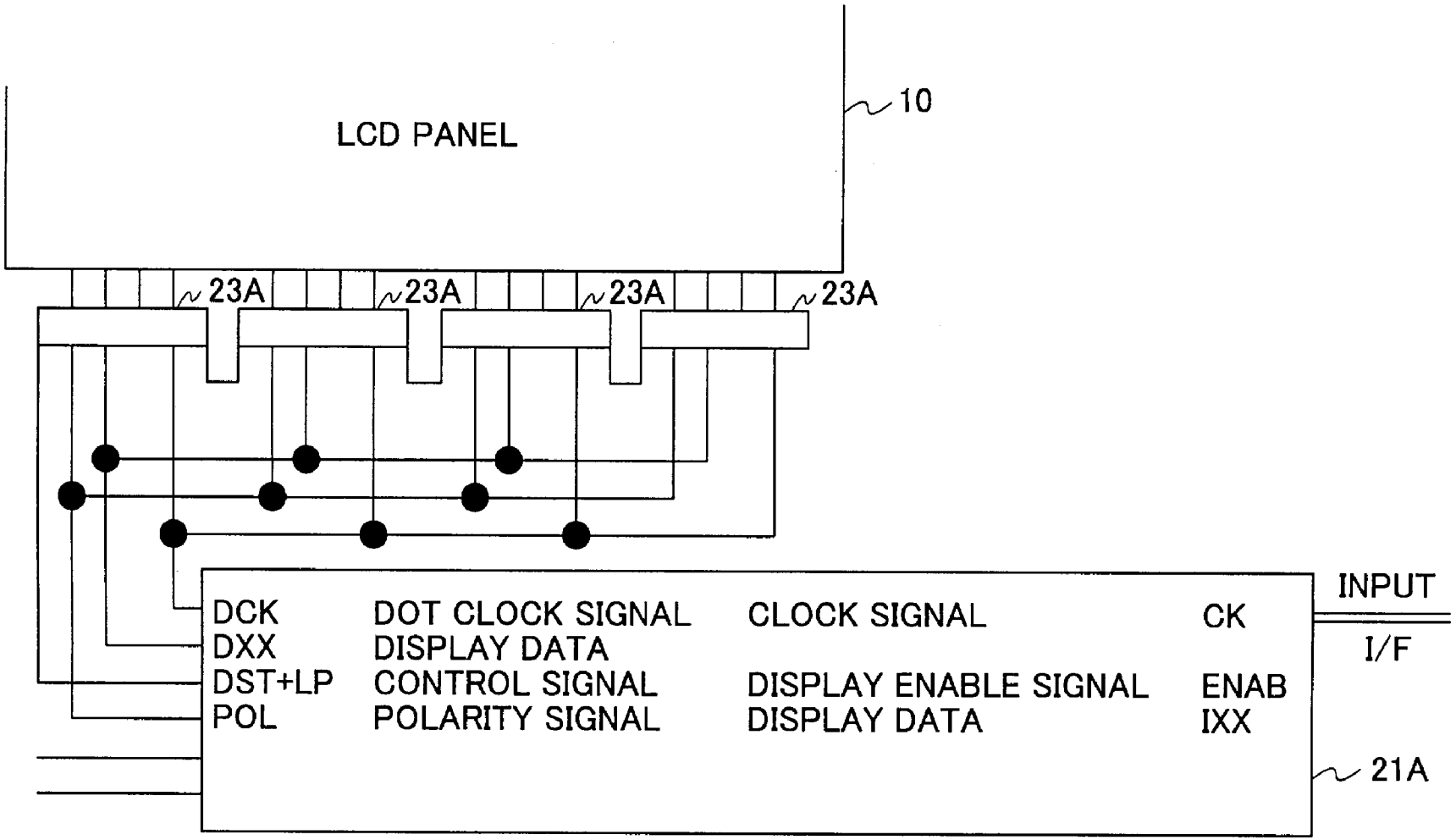
FIG. 12 is a diagram illustrating a structure of a liquid crystal display according to a second embodiment of the present invention.

FIG. 12 shows a structure of a liquid crystal display according to the second embodiment of the present invention.

The liquid crystal display according to the second embodiment differs from that according to the first embodiment in only a portion related to the data control signal. Accordingly, FIG. 12 shows only components related to the data driver. As is shown in FIG. 12, a control signal supplied to a data driver 23A by a timing controller 21A contains a dot clock signal DCK, a control signal DST+LP, and a polarity signal POL. The single control signal DST+LP integrally contains the data start signal DST and the latch pulse LP mentioned with respect to FIG. 1. The data driver 23A extracts logical levels of the start signal DST and the latch pulse LP from the received control signal DST+LP and uses the dot clock signal DCK, the polarity signal POL and the display data DXX that are received from the timing controller 21A to perform the predetermined operation similar to the data driver mentioned in FIG. 1.

Figure 13:
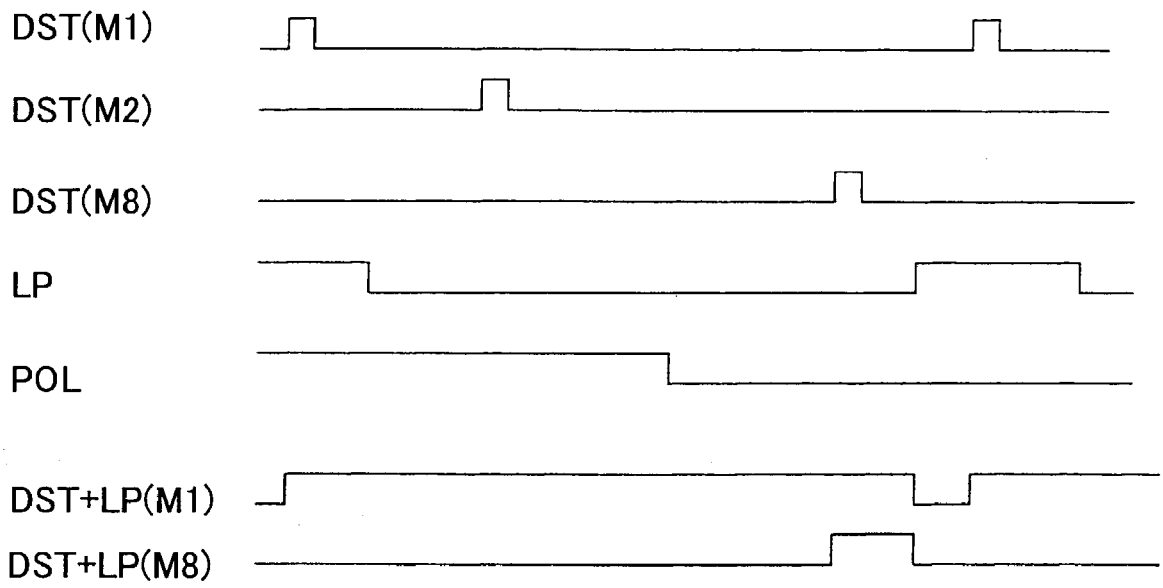
FIG. 13 is a diagram illustrating control signals DST+LP.

FIG. 13 shows the control signal DST+LP. FIG. 13 shows a control signal DST+LP for the head data driver 23A and a control signal DST+LP for the eighth data driver 23A together with the latch pulse LP.

As is shown in FIG. 13, the control signal DST+LP becomes HIGH at timing of the data start signal DST and LOW at timing of the latch pulse LP. In a case where data drivers 23A are connected in the cascade fashion, after an input control signal DST+LP becomes HIGH, each of the data drivers 23A sets an output control signal DST+LP as HIGH at one clock before the data driver 23A finishes reading data. It is desired that the display data are transmitted to an internal DA converter at the same timing for all the data drivers 23A. Thus, when the input control signal DST+LP becomes HIGH, the output control signal is set to become LOW asynchronously with a clock.

Figure 14:
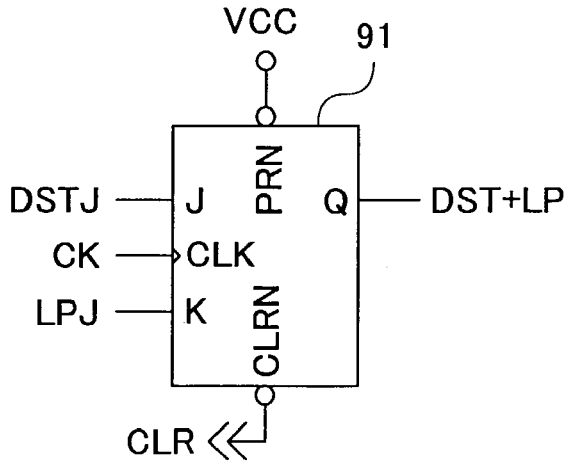
FIG. 14 is a diagram illustrating a circuit structure for generating the control signals DST+LP in the timing controller.

FIG. 14 shows a circuit structure for generating the control signal DST+LP in the timing controller 21A.

The circuit in FIG. 14 contains a JK flip-flop 91. The JK flip-flop 91 receives a signal DSTJ for designating a conventional data start signal DST to become HIGH as the J input and a signal LPJ for designating a conventional latch pulse LP to become HIGH as the K input in order to generate a control signal DST+LP.

Figure 15:
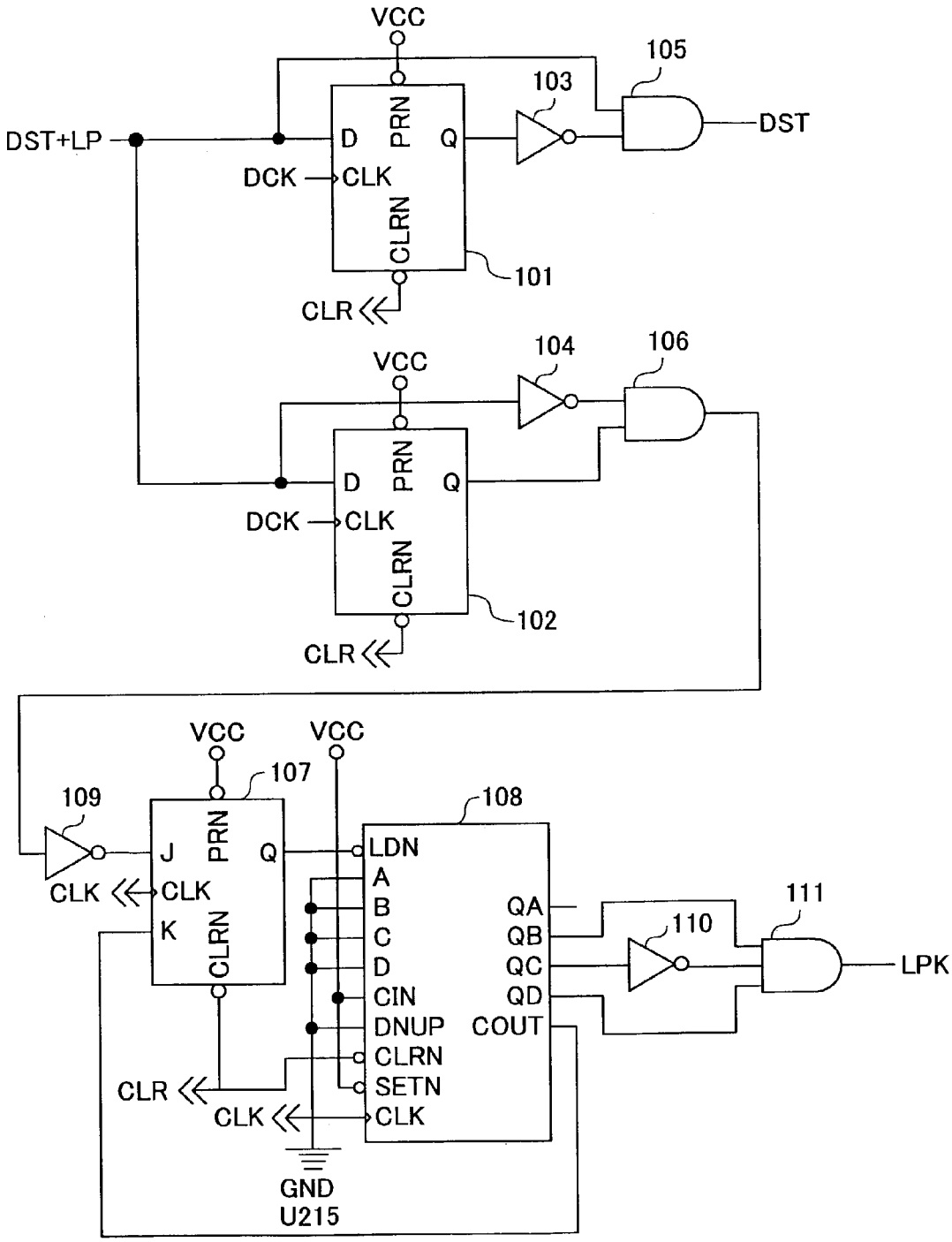
FIG. 15 is a diagram illustrating a circuit structure for extracting a data start signal DST and a latch pulse LP from the control signal DST+LP in the data driver.

FIG. 15 shows a circuit structure for extracting the data start signal DST and the latch pulse LP from the control signal DST+LP in a data driver 23A.

The circuit in FIG. 15 contains D flip-flops 101 and 102, inverters 103 and 104, AND circuits 105 and 106, a JK flip-flop 107, a counter circuit 108, inverters 109 and 110, and an AND circuit 111.

The AND circuit 105 takes AND of the inverted signal of the control signal DST+LP fetched by the D flip-flop 101 synchronously with a clock signal, which is delayed because of the clock synchronization, and the control signal DST+LP to generate a data start signal DST. Also, the AND circuit 106 takes AND of the inverted signal of the control signal DST+LP fetched by the D flip-flop 102 synchronously with a clock signal, which is delayed because of the clock synchronization, and the control signal DST+LP to generate a signal for indicating timing of the latch pulse LP. Based upon the timing signal, the JK flip-flop 107 resets the counter circuit 108, and the counter circuit 108 starts to count with the reset timing. A data output start timing LPK within the data driver 23A is generated at predetermined timing when the counter circuit 108 counts.

Figure 16:
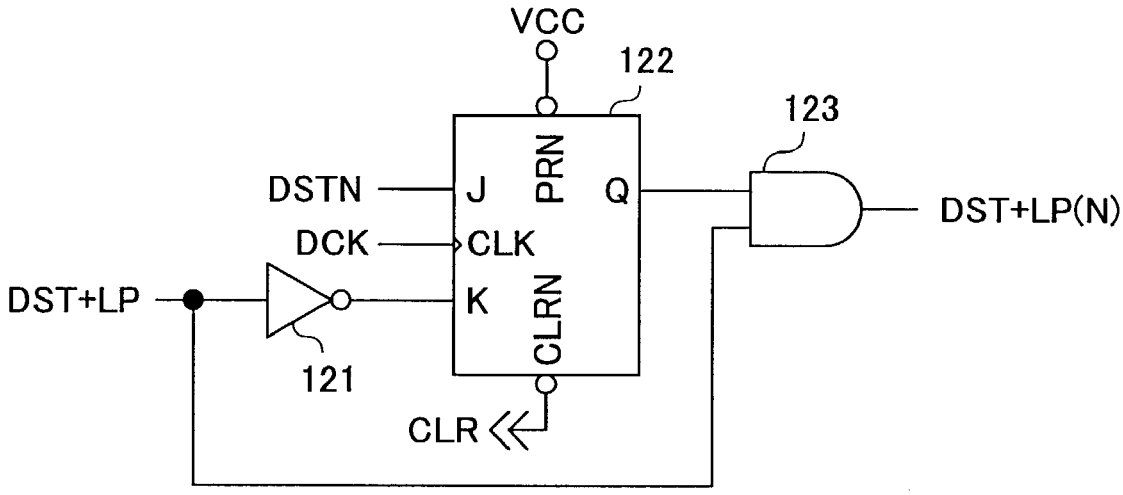
FIG. 16 is a diagram illustrating a circuit structure for generating an output control signal DST+LP for the next stage from an input control signal DST+LP in the data driver.

FIG. 16 shows a circuit structure for generating an output control signal DST+LP for the next data driver 23A from an input control signal DST+LP in a data driver 23A.

The circuit in FIG. 16 contains an inverter 121, a JK flip-flop 122, and an AND circuit 123. The JK flip-flop 122 receives a signal DSTN for indicating a data start timing for a data driver 23A being at the next stage as the J input and the inverted signal of a control signal DST+LP as the K input. The signal DSTN causes an output signal of the JK flip-flop 122 to become HIGH synchronously with a clock. The control signal DST+LP causes the output signal of the JK flip-flop 122 to become LOW synchronously with the clock. As is describe with respect to FIG. 13, the AND circuit takes AND of the output of the JK flip-flop 122 and the control signal DST+LP so that an output control signal DST+LP(N) for the next data driver 23A can become LOW asynchronously with the clock.

Figure 17:
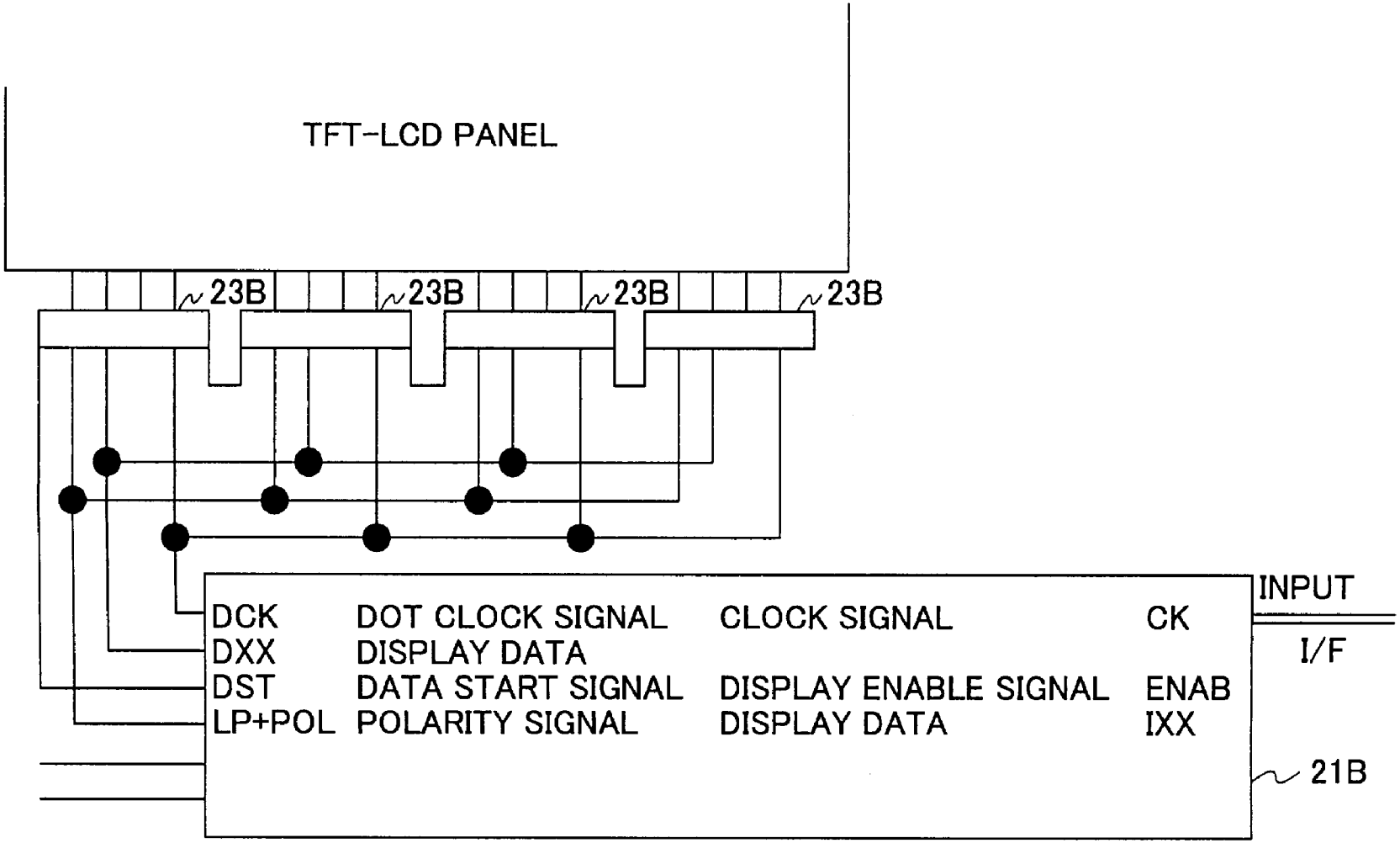
FIG. 17 is a diagram illustrating a liquid crystal display according to a third embodiment of the present invention.

FIG. 17 shows a structure of a liquid crystal display according to the third embodiment of the present invention.

The liquid crystal display according to the third embodiment differs from that according to the first embodiment in only a portion related to a data control signal. Accordingly, FIG. 17 shows only components related to a data driver. As is shown in FIG. 17, a control signal supplied to a data driver 23B by a timing controller 21B contains a dot clock signal DCK, a data start signal DST, and a control signal LP+POL. The single control signal LP+POL integrally contains the latch pulse LP and the polarity signal POL described with respect to FIG. 1. The data driver 23B extracts logic levels of the data start signal DST and the polarity signal POL from the received control signal LP+POL and uses the data start signal DST and the display data DXX to perform the predetermined operation similar to the data driver mentioned with respect to FIG. 1.

Figure 18:
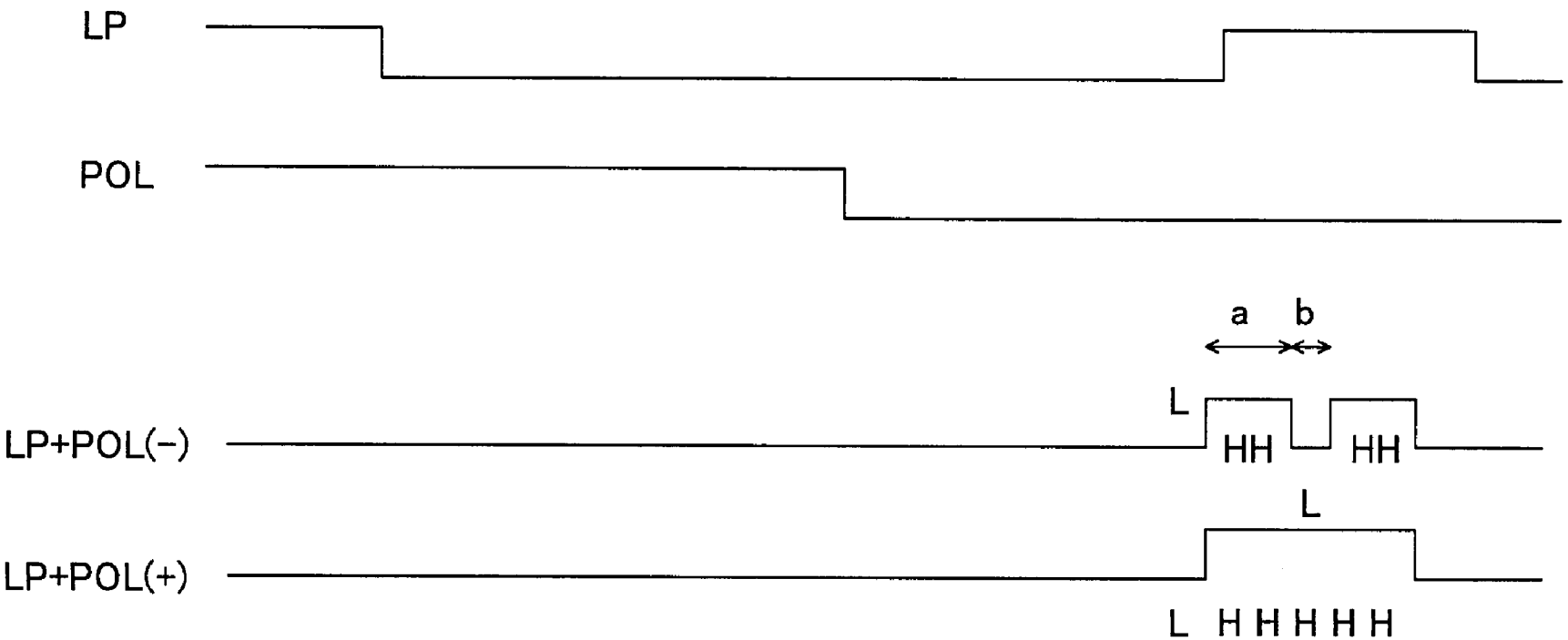
FIG. 18 is a diagram illustrating control signals LP+POL.

FIG. 18 shows a control signal LP+POL.

As is shown in FIG. 18, the control signal LP+POL is a signal that becomes HIGH at timing when the latch pulse LP becomes HIGH. After the control signal LP+POL becomes HIGH, the polarity signal POL is determined based on the logical level of the control signal LP+POL in a predetermined clock interval "b" after a predetermined clock number "a". FIG. 18 shows an example where the polarity signal POL is a negative polarity if the control signal LP+POL is LOW in one clock after the control signal LP+POL becomes HIGH in two clocks, and the polarity signal POL is a positive polarity if the control signal LP+POL is HIGH in one clock after the control signal LP+POL becomes HIGH in two clocks.

Figure 19:
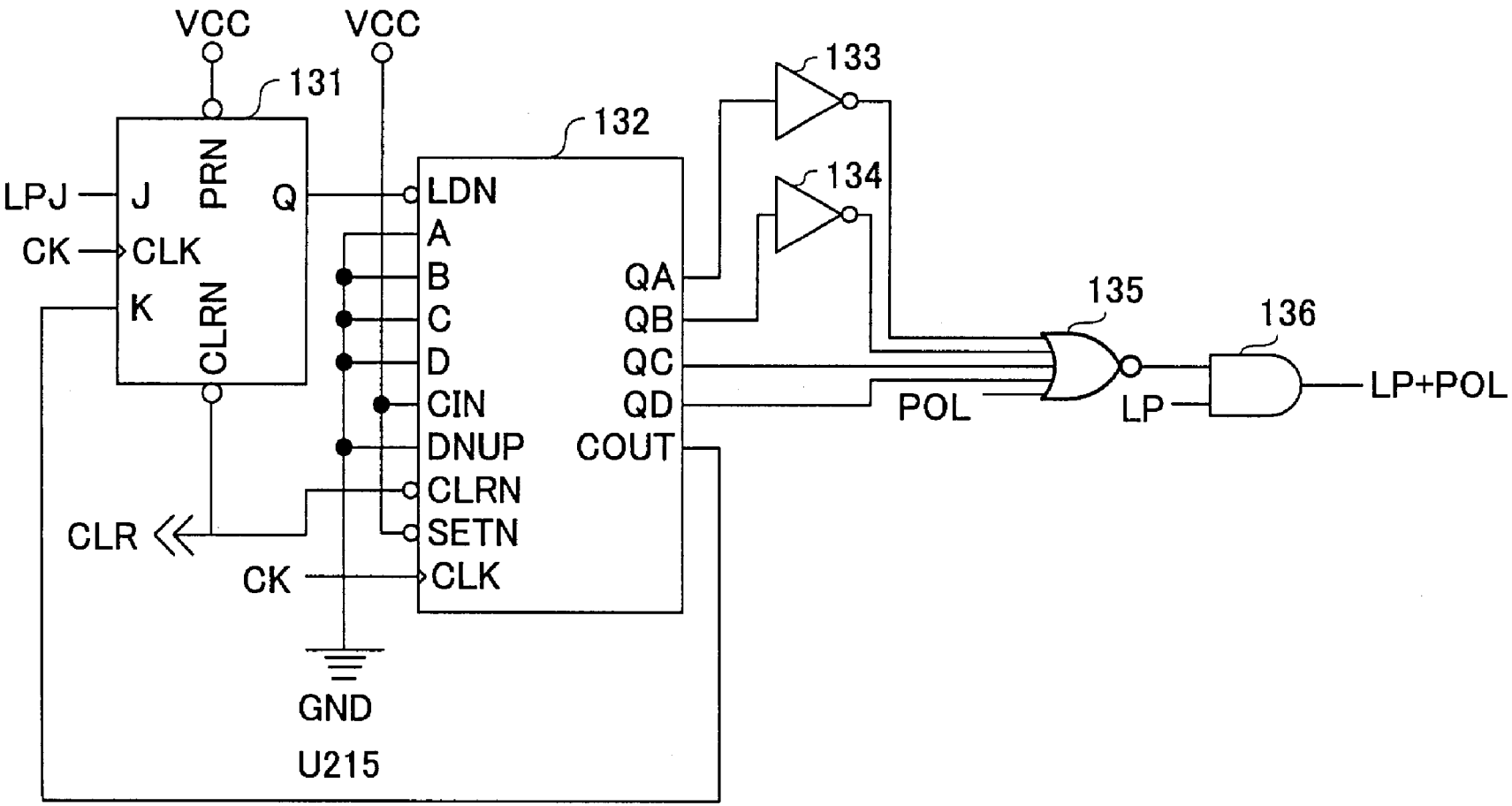
FIG. 19 is a circuit illustrating a circuit structure for generating the control signals LP+POL in the timing controller.

FIG. 19 shows a circuit structure for generating a control signal LP+POL in the timing controller 21B.

The circuit in FIG. 19 contains a JK flip-flop 131, a counter circuit 132, inverters 133 and 134, an OR circuit 135, and an AND circuit 136. The JK flip-flop 131 receives a signal LPJ for indicating timing when the latch pulse LP becomes HIGH as the J input. The JK flip-flop 131 causes the counter circuit 132 to be reset as zero at timing when the latch pulse LP becomes HIGH. Then, the counter circuit 132 starts to count clock pulses of a clock signal CK. The inverters 133 and 134 and the OR circuit 135 perform logical operations for an output of the counter circuit 132 to generate a signal being LOW only in the clock interval "b" in FIG. 18. An output of the OR circuit 135 is a disjunction of the generated signal and the polarity POL. Thus, when the polarity POL is LOW, the output of the OR circuit 135 is LOW only in the clock interval "b", and when the polarity POL is HIGH, the output of the OR circuit 135 is HIGH regardless of the other factors. The AND circuit 136 takes AND of the output signal of the OR circuit 135 and the latch pulse LP to generate the control signal LP+POL.

Figure 20:
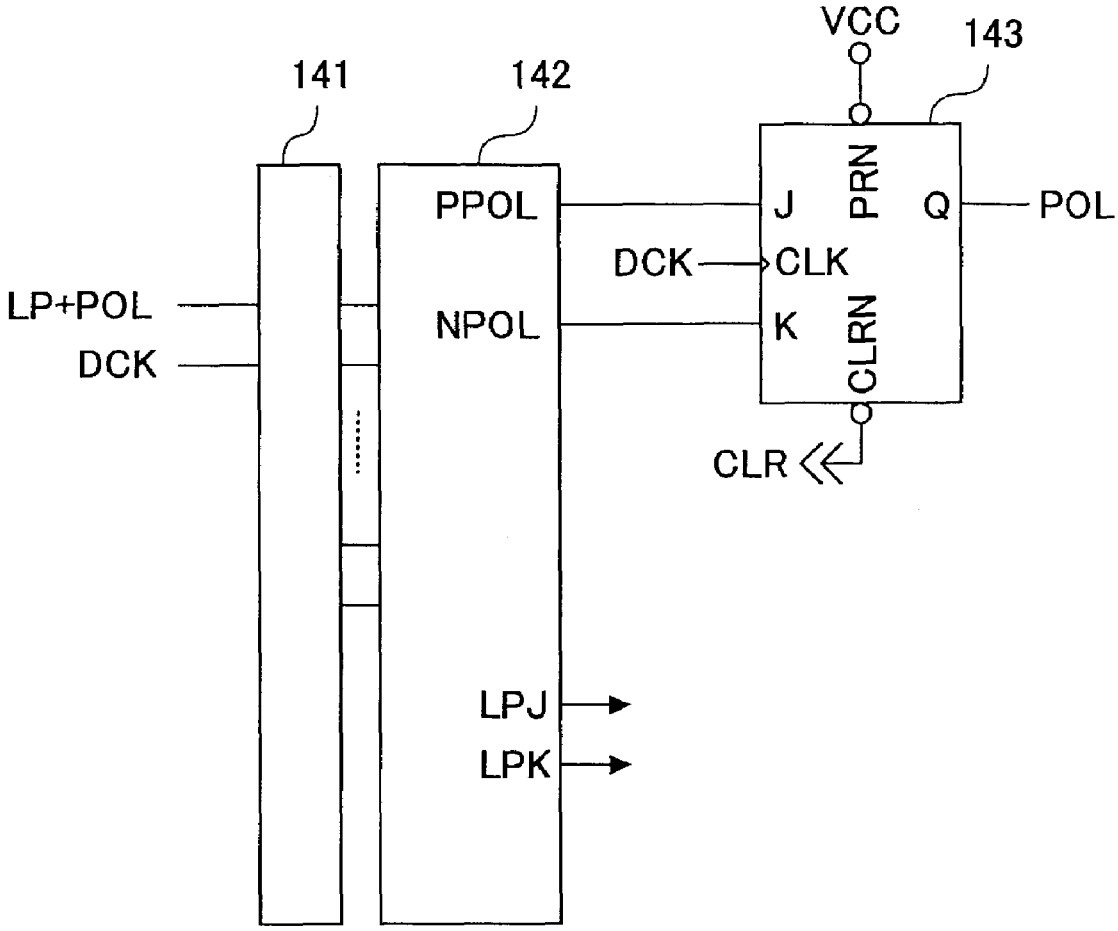
FIG. 20 is a diagram illustrating a circuit structure for extracting the latch pulse LP and a polarity POL from the control signal LP+POL in the data driver.

FIG. 20 shows a circuit structure for extracting a latch pulse LP and a polarity POL from the control signal LP+POL in a data driver 23B.

The circuit in FIG. 20 contains a shift register circuit 141, a decoder circuit 142, and a JK flip-flop circuit 143. The shift register circuit 141 sequentially stores a control signal LP+POL supplied thereto in an internal register circuit synchronously with a dot clock signal DCK. The decoder circuit 142 decodes data formed of a plurality of cycles of the control signal LP+POL stored by the shift register circuit 141 to generate detection signals PPOL, NPOL, LPJ, and LPK. Here, the detection signals PPOL, NPOL, LPJ, and LPK represent positive polarity detection, negative polarity detection, latch pulse HIGH detection, and latch pulse LOW detection. For instance, the detection signal PPOL is implemented by a logic circuit to set the detection signal PPOL to become HIGH only if a control signal LP+POL at a current cycle is HIGH, a control signal LP+POL at the first previous cycle is HIGH, a control signal LP+POL at the second previous cycle is HIGH, a control signal LP+POL at the third previous cycle is HIGH, and a control signal LP+POL at the fourth previous cycle is HIGH.

By considering the positive polarity detection as a start point, the JK flip-flop 143 is generating a polarity signal POL being HIGH until a negative polarity is detected. The polarity signal POL controls the polarity of an output data of a data driver 23B.

Figure 21:
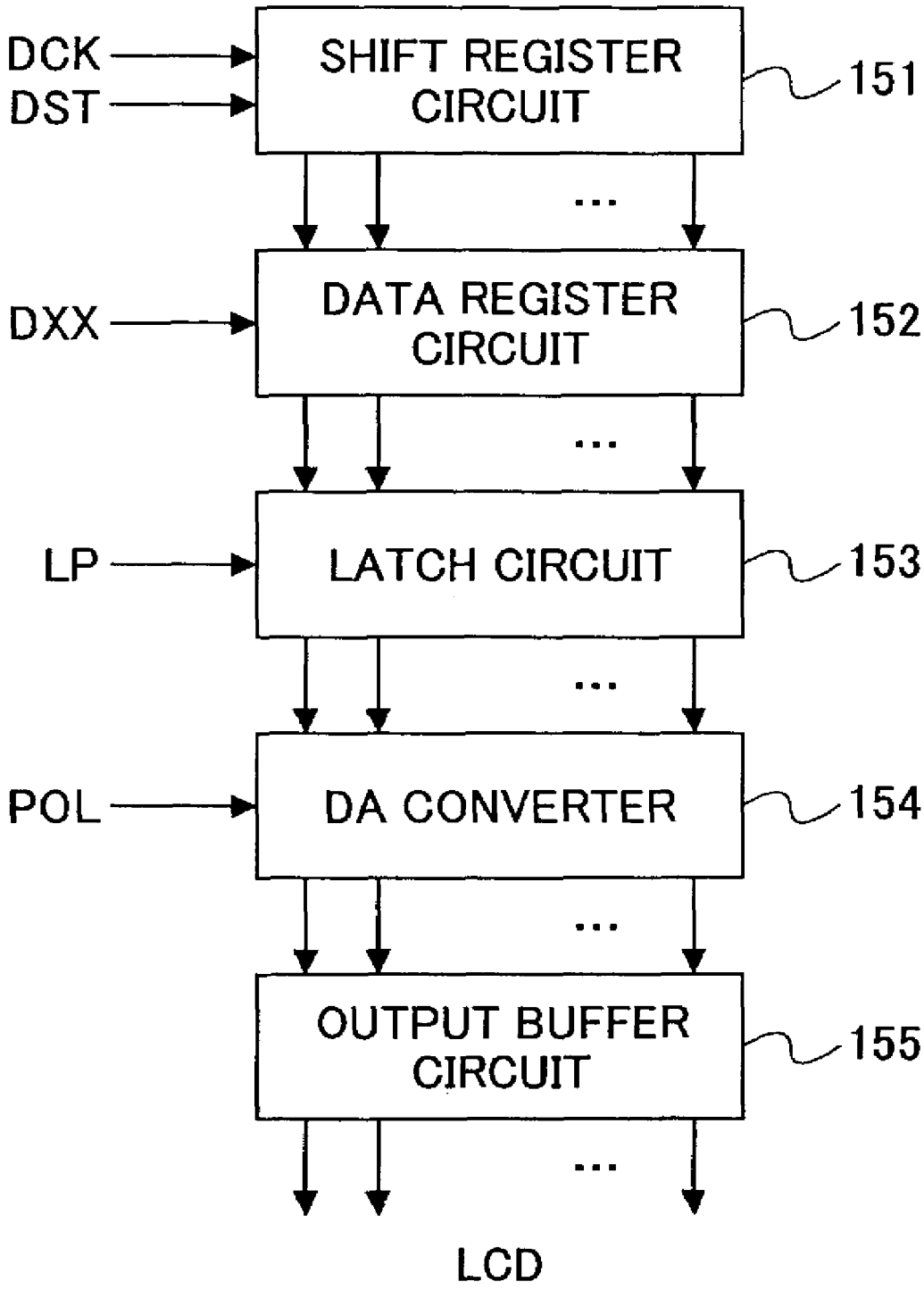
FIG. 21 is a diagram illustrating a structure of a display data processing part in the data driver.

FIG. 21 shows a structure of a display data processing part of a data driver to which the present invention is applied.

The data driver in FIG. 21 contains a shift register circuit 151, a data register circuit 152, a latch circuit 153, a DA converter 154, and an output buffer circuit 155.

A data start signal DST is a signal for indicating the start position of a portion of the display data DXX displayed by the data driver. Timing of the data start signal DST is set as the start point, and a data sampling signal is supplied to the data register circuit 152 by sequentially shifting registers synchronously with the dot clock signal DCK. The data register circuit 152 sequentially stores the display data DXX corresponding to each dot through the data sampling signal in the register. The latch pulse LP is a signal for latching the display data DXX sequentially stored by the data register circuit 152 in the latch circuit 153. The latched display data signal is transmitted to the DA converter 154. The DA converter 154 converts the transmitted display signal into an analog gradation signal and then outputs the resulting signal to the LCD panel as a data line driving signal via the output buffer circuit 155. Also, the DA converter 154 uses the polarity signal POL to determine the output polarity of an individual data line for a common voltage.

As mentioned with respect to the above-mentioned embodiments, the control signals DCK, DST, LP, and POL are generated according to need under the present invention.

A description will now be given of an additional embodiment of the present invention. The following embodiments are related to a liquid crystal display that can reduce the number of data signal lines supplied to a data driver thereof as the compatibility of an interface with a conventional apparatus is maintained.

Figure 22:
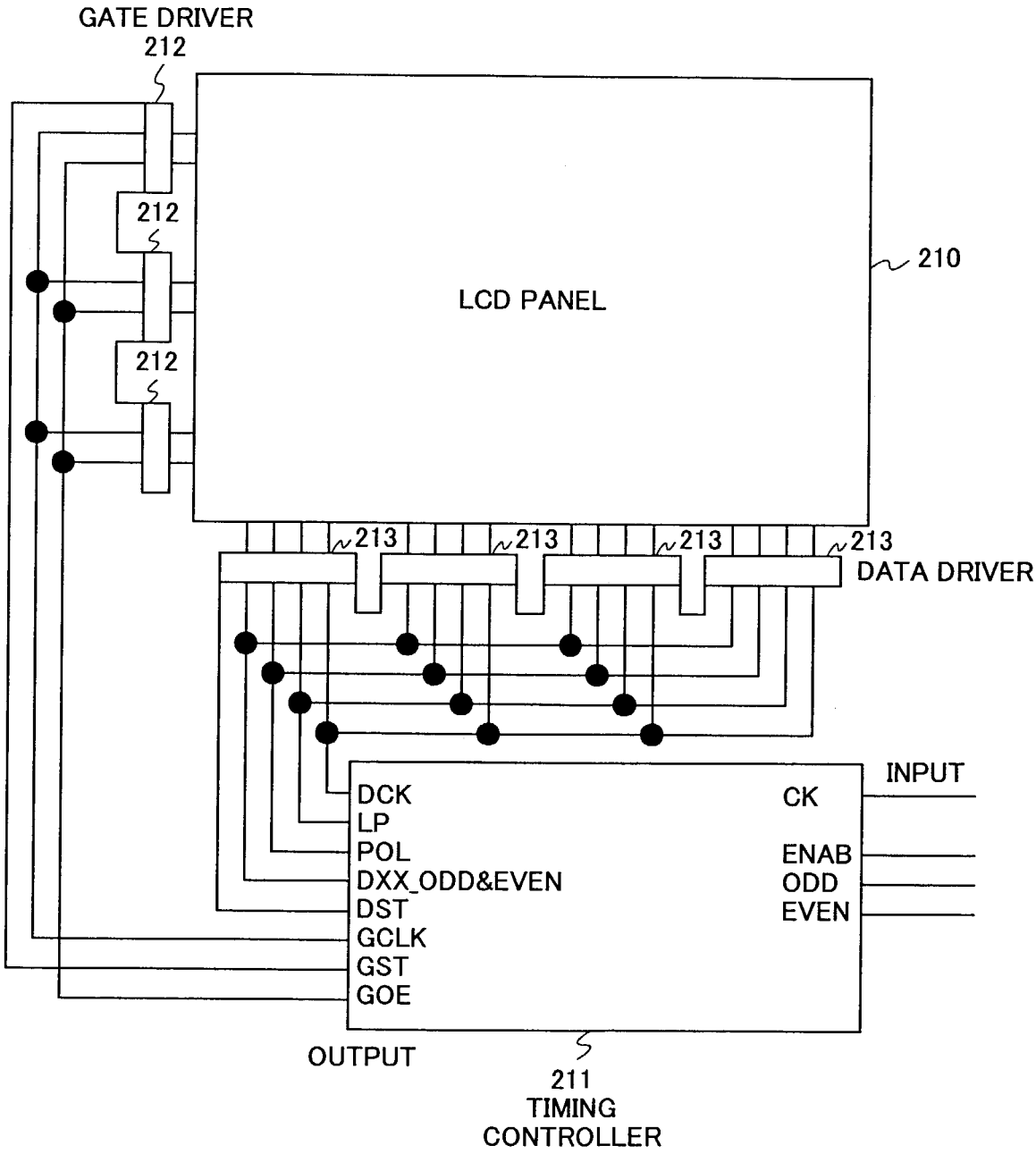
FIG. 22 is a diagram illustrating a structure of a liquid crystal display according to another embodiment of the present invention.

FIG. 22 shows a structure of a liquid crystal display according to the additional embodiment of the present invention.

The liquid crystal display in FIG. 22 contains an LCD panel 210, a timing controller 211, a plurality of gate drivers 212, and a plurality of data drivers 213. Dots including transistors, which are not illustrated in FIG. 22, are provided in the horizontal and vertical directions of the LCD panel 210. Gate lines extending in the horizontal direction from the gate drivers 212 are connected to gates of the transistors in the individual dots, and data line extending in the vertical direction from the data drivers 213 are connected to capacitors of the individual dots via the transistors.

The timing controller 211 receives a clock signal CK, two types of display data ODD and EVEN, and a display enable signal ENAB for indicating timing of a display position. The timing controller 211 counts the number of the display enable signals ENAB to determine timing with respect to a vertical position, and additionally counts clock pulses of the clock signal CK since the display enable signal ENAB becomes HIGH in order to determine timing of a horizontal position. Then, the timing controller 211 generates various control signals and the display data DXX.

The liquid crystal display according to this embodiment differs from that according to the first embodiment in the supply method of the display data. Although especially not illustrated in FIG. 1, the timing controller 11 receives the two types ODD and EVEN of input display data IXX and also generates the two types ODD and EVEN of output display data DXX. On the other hand, while the timing controller 211 in FIG. 22 receives the two types ODD and EVEN of input display data IXX and serves as a conventional interface with a host apparatus, the timing controller 211 outputs as the display data a single signal DXX_ODD&EVEN formed by integrating the two types ODD and EVEN. However, the liquid crystal display according to this embodiment performs the same operations with respect to the signal control as that according to the first embodiment except that the two types of display data EVEN and ODD are integrated into the signal DXX_ODD&EVEN.

Figure 23:
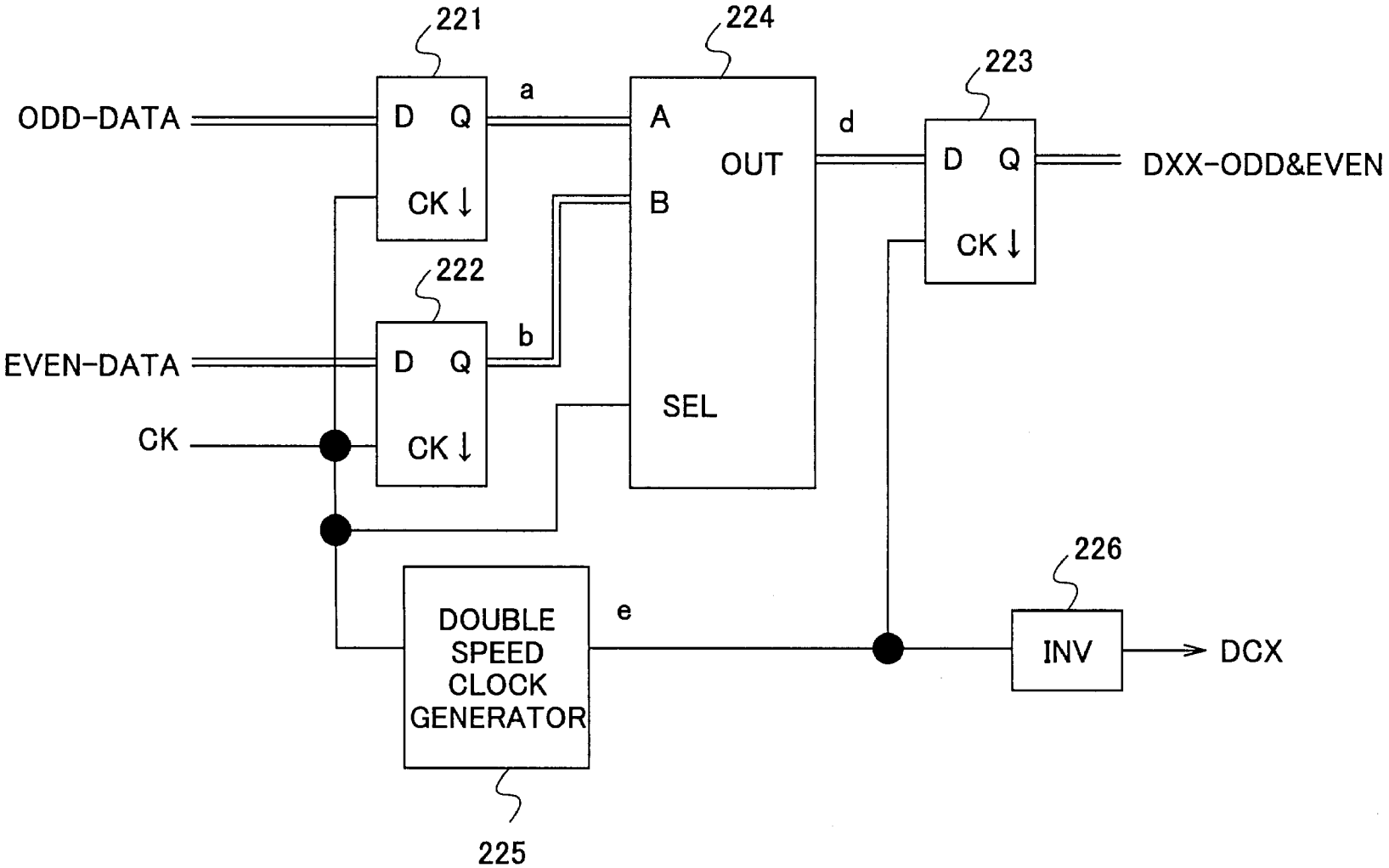
FIG. 23 is a diagram illustrating a circuit structure for integrating two types of display data EVEN and ODD in the timing controller.

FIG. 23 shows a circuit structure of an integrating part integrating the two types of display data EVEN and ODD in the timing controller 211. Also, FIG. 24 is a timing chart illustrating signal waveforms of individual components in the circuit shown in FIG. 23.

The circuit in FIG. 23 contains flip-flops 221 through 223, a selector circuit 224, a double speed clock generator 225, and an inverter 226. The flip-flop 221 and 22 fetches odd number display data ODD_DATA and even number display data EVEN_DATA synchronously with the clock signal CK, respectively. As is shown in FIG. 24, the fetched signals a and b are supplied to the A input and the B input of the selector circuit 224, respectively. The selector circuit 224 uses the clock signal CK as a selection signal SEL to select the signal a of the A input and the signal b of the B input alternately. The selected signal is supplied as a signal d to the flip-flop 223. The double speed clock generator 225, which is formed of a PLL circuit and the like, generates a clock signal e having the double frequency based on the clock signal CK. The flip-flop 223 fetches the signal d selected by the selector circuit 224 synchronously with the clock signal e having the double frequency. The fetched signal in the flip-flop 223 is output as a single signal DXX_ODD&EVEN. Also, the inverter 226 inverts the clock signal e having the double frequency and then outputs the inverted signal as a dot clock signal DCK.

Figure 24:
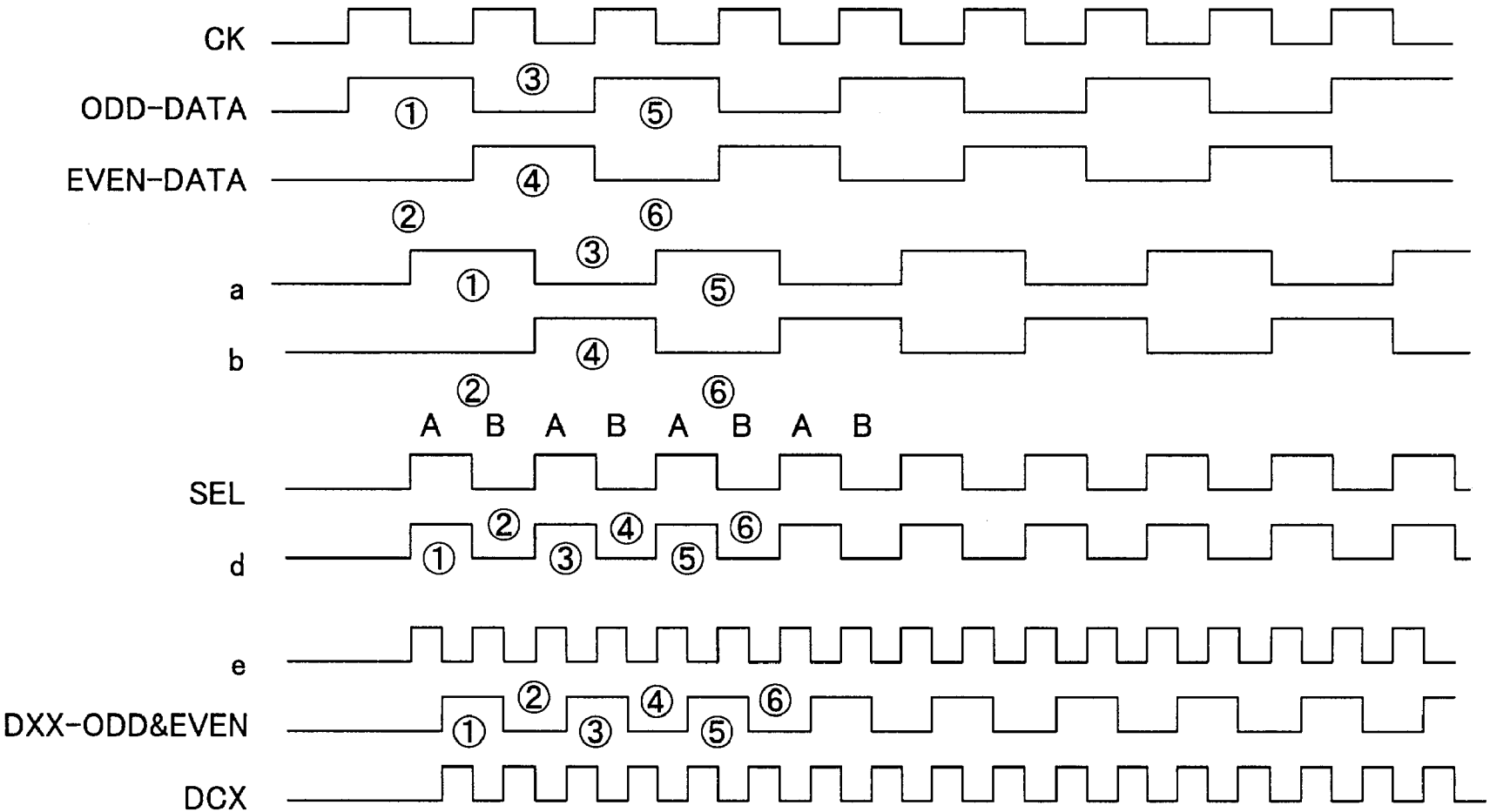
FIG. 24 is a timing chart illustrating signal waveforms of individual components in the circuit in FIG. 23.

As mentioned above, in the embodiment described with respect to FIGS. 22 through 24, the timing controller 211 serves to integrate the two types of display data EVEN and ODD into single display data and then supplies the single display data to the data driver 213. As a result, it is possible to reduce the number of display data lines from the timing controller 211 to the data driver 213 as the compatibility of the conventional interface with an external apparatus is maintained. The data driver 213 has the same fundamental structure as the data driver shown in FIG. 21 except for the number of display data lines. If the improved working speed of a driver due to the recent development of the process technique is taken into account, it is possible to easily fabricate a driver that can correspond to the double transmission speed by integrating conventional two types of transmission paths into a single path.

Figure 25:
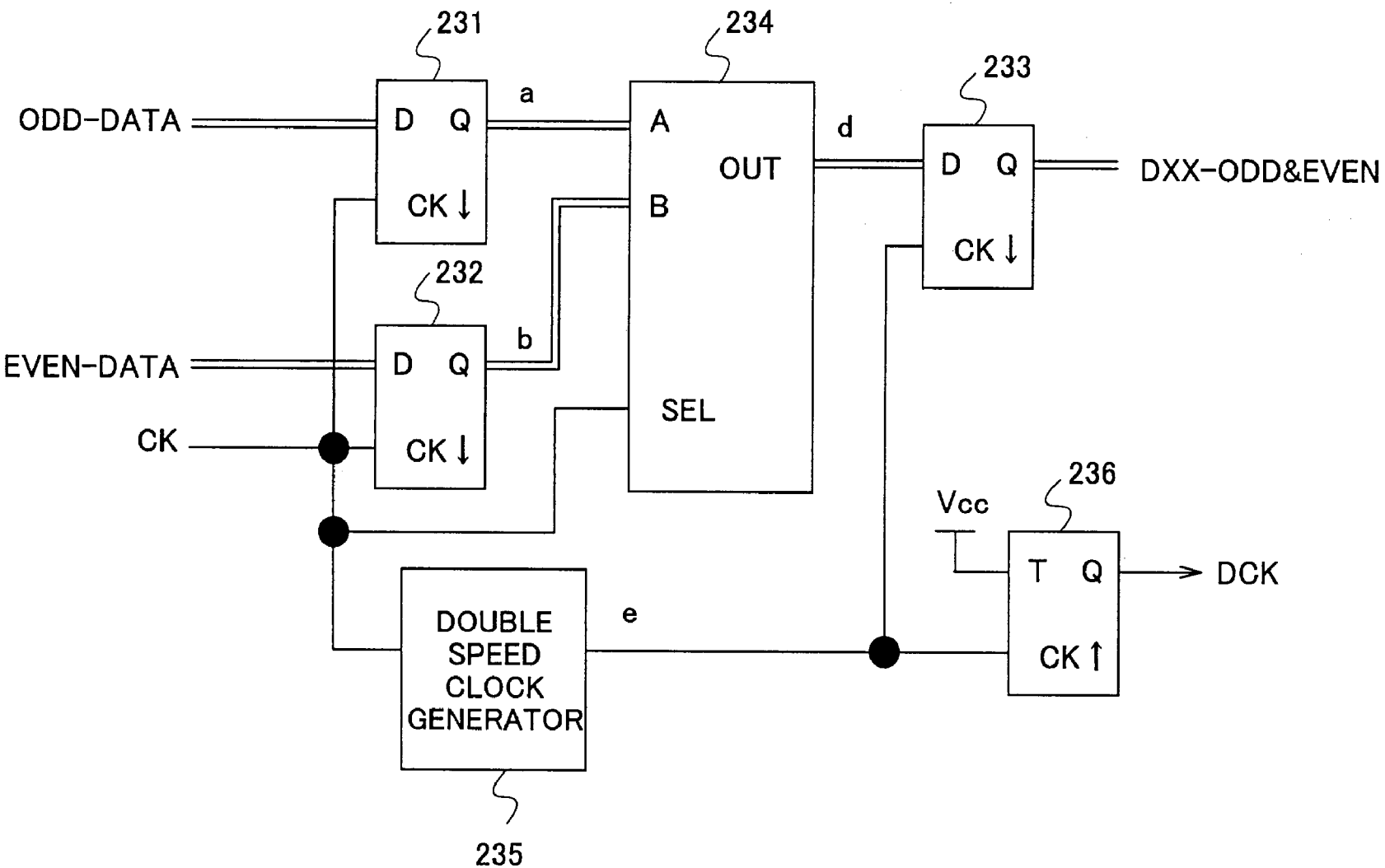
FIG. 25 is a diagram illustrating another circuit structure for integrating two types of display data EVEN and ODD in the timing controller.
Figure 26:
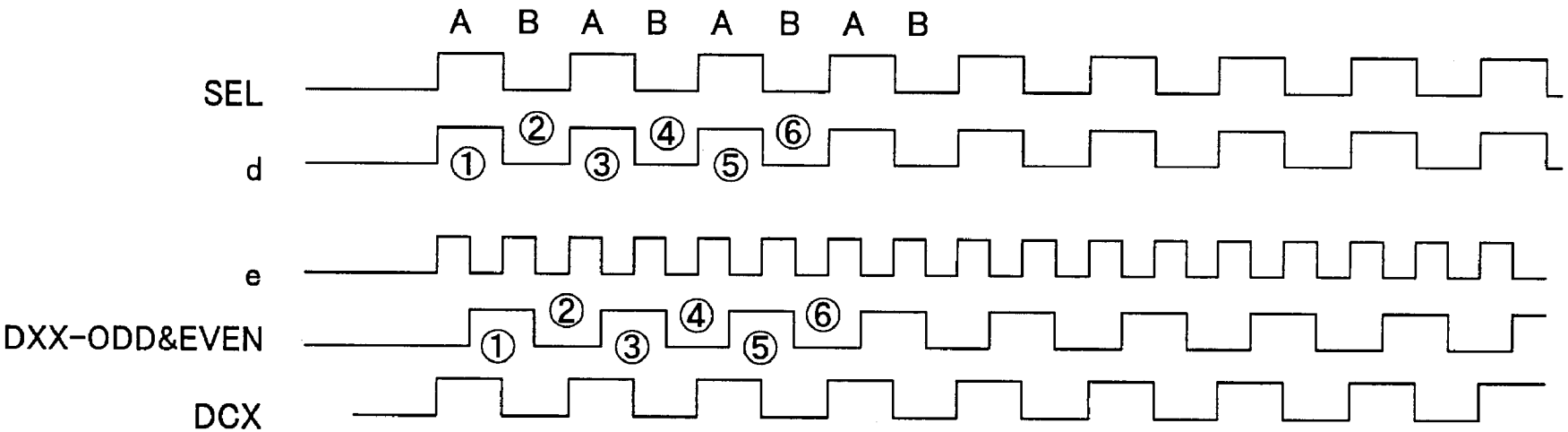
FIG. 26 is a timing chart illustrating signal waveforms of individual components in the circuit in FIG. 25.

FIG. 25 shows another circuit structure of the part for integrating the two types of display data EVEN and ODD in the timing controller 211. Also, FIG. 26 is a timing chart illustrating signal waveforms of components in the circuit shown in FIG. 25.

The circuit in FIG. 25 contains flip-flops 231 through 233, a selector circuit 234, a double speed clock generator 235, and a toggle flip-flop 236. The flip-flops 231 and 232 fetch odd number display data ODD_DATA and even number display data EVEN_DATA, respectively. The fetched signals a and b are supplied to an A input and a B input of the selector circuit 234, respectively. The selector circuit 234 uses a clock signal CK as a selection instruction signal SEL to select the signals a and b alternately. As is shown in FIG. 26, the selected signal is supplied as a signal d to the flip-flop 233. The double speed clock generator 235, which is formed of a PLL circuit and the like, generates a clock signal e having the double frequency based on the clock signal CK and then supplies the signal e to the flip-flop 233. The flip-flop 233 fetches the selected signal d synchronously with the clock signal e having the double frequency. The fetched signal is output as a single signal DXX_ODD&EVEN. Heretofore, the timing controller according to this embodiment operates similarly to the timing controller shown in FIGS. 23 and 24.

In FIG. 25, the toggle flip-flop 236 is synchronized with the rising edge of the clock signal e having the double frequency and repeats inversion operations for the output so as to alternate HIGH and LOW. As a result, as is shown in FIG. 26, it is possible to generate a dot clock DCK having the half frequency of the signal e.

The timing controller in FIG. 25 has the structure corresponding to the case where the double edge clock method is applied. Under the double edge clock method, display data are stored in a data register circuit in the data driver 213 synchronously with both the rising edge and the falling edge of the dot clock signal DCK. Thus, it is possible to divide the frequency of the dot clock DCK into ½ compared with the case where either the rising edge or the falling edge of the dot clock signal DCK is only used as the synchronization timing.

The present invention is not limited to the specifically disclosed embodiments, and variations and modifications may be made without departing from the scope of the present invention.

What is claimed is:

1. A liquid crystal display, comprising:

a liquid crystal panel containing a data line;

a data driver driving said data line; and a controller outputting N control functions for controlling a driving operation of said data driver through less than or equal to (N−1) control signal lines connected to said data driver, wherein said controller outputs N control signal lines via (N−1) control signal lines by combining at least two control signal lines into a single control signal line corresponding to a change point of each control signal based on a predetermined logic.

2. The liquid crystal display as claimed in claim 1, wherein less than or equal to said (N−1) control signal lines are exactly one control signal line, and said controller performs said N control functions by outputting a time series code through said control signal line.

3. The liquid crystal display as claimed in claim 2, wherein a plurality of said data drivers are provided and are connected in a cascade fashion via said control signal line, and said time series code contains a code for designating a mode where a signal transmiffed via said control signal line directly passes between inputs and outputs of said data drivers.

4. The liquid crystal display as claimed in claim 2, wherein said N control functions contain a data start function of designating data start timing of said data driver, a latch pulse function of designating timing when display data are stored in an internal latch of said data driver, and a polarity function of designating a polarity of said data line.

5. The liquid crystal display as claimed in claim 2, wherein a plurality of said data drivers are provided, and less than or equal to said (N−1) control signal lines contain a control signal line connected to each of said data drivers and a control signal line connected in a cascade fashion between said data drivers.

6. A liquid crystal display, comprising:

a liquid crystal panel containing a gate line;

a gate driver driving said gate line; and a controller outputting N control functions of controlling a driving operation of said gate driver driving said gate line through less than or equal to (N−1) control signal lines connected to said gate driver, wherein said controller outputs N control signal lines via (N−1) control signal lines by combining at least two control signal lines into a single control signal line corresponding to a change point of each control signal based on a predetermined logic.

7. The liquid crystal display as claimed in claim 6, wherein less than or equal to said (N−1) control signal lines are exactly one control signal line, and said controller represents a start pulse function of designating timing when a head gate line is driven and a gate clock function of designating timing when an individual gate line to be driven is sequentially shifted by a signal output to said control signal line.

8. The liquid crystal display as claimed in claim 7, wherein said gate driver extracts said start pulse function by examining a level of a signal transmitted through said control signal line based on said signal being at a predetermined time period before said signal changes.

* * * * *